US005677718A

United States Patent [19]

Crawford et al.

[11] Patent Number: 5,677,718

[45] Date of Patent: Oct. 14, 1997

[54] DROP-ON-DEMAND INK JET PRINT HEAD HAVING IMPROVED PURGING PERFORMANCE

[75] Inventors: Clark W. Crawford; Ronald F. Burr, both of Wilsonville, Oreg.

[73] Assignee: Tektronix, Inc., Wilsonville, Oreg.

[21] Appl. No.: 327,591

[22] Filed: Oct. 24, 1994

Related U.S. Application Data

[63] Continuation of Ser. No. 894,316, Jun. 4, 1992, abandoned.

[51] Int. Cl.[6] ..... B41J 2/19

[52] U.S. Cl. ..... 347/92; 347/30; 347/94

[58] Field of Search ..... 347/92, 94, 30, 347/84

[56] References Cited

U.S. PATENT DOCUMENTS

| | | | |
|---|---|---|---|
| 4,123,761 | 10/1978 | Kimura et al. | 346/140 R |
| 4,216,477 | 8/1980 | Matsuda et al. | 346/140 R |
| 4,367,480 | 1/1983 | Kotoh | 346/140 R |
| 4,387,383 | 6/1983 | Sayko | 346/140 R |
| 4,521,788 | 6/1985 | Kimura et al. | 346/140 R |
| 4,528,575 | 7/1985 | Matsuda et al. | 346/140 R |
| 4,680,595 | 7/1987 | Cruz-Uribe et al. | 346/140 R |
| 4,727,378 | 2/1988 | Le et al. | 346/140 R |
| 4,730,197 | 3/1988 | Raman et al. | 346/140 R |
| 4,809,024 | 2/1989 | De Young et al. | 346/140 R |
| 4,883,219 | 11/1989 | Anderson et al. | 228/346 |
| 5,087,930 | 2/1992 | Roy et al. | 346/140 R |
| 5,113,205 | 5/1992 | Sato et al. | 346/140 R |
| 5,184,147 | 2/1993 | MacLane et al. | 347/30 |

FOREIGN PATENT DOCUMENTS

| | | | |
|---|---|---|---|
| 55-067478 | 5/1980 | Japan | B41J 3/04 |
| 63-97650 | 8/1988 | Japan . | |

*Primary Examiner*—John E. Barlow, Jr.
*Assistant Examiner*—Raquel Yvette Gordon
*Attorney, Agent, or Firm*—Ralph D'Alessandro; Richard B. Preiss

[57] ABSTRACT

A compact ink jet print head has cross-sectionally tapered ink manifolds (16) for supplying ink to ink supply channels (18) leading to the acoustically driven ink pressure chambers (22). An array of closely spaced nozzles (14) which are supplied with ink from the densely packed ink pressure chambers by way of offset channels (71). The tapered manifolds, ink supply channels, pressure chambers, and offset channels are designed to provide uniform operating characteristics among the ink jet nozzles of the array. To enhance the packing density of the pressure chambers, the ink supply channels leading to the pressure chambers and offset channels are positioned in planes between the pressure chambers and nozzles. The tapered ink supply manifolds enhance purging of contaminants or bubbles from the print head by providing uniform ink flow rates (97, 97') along the entire length of the manifolds. Optional ink purging channels (42) are provided for purging bubbles and other contaminants from the print head without requiring ink flow through the nozzles. The ink jet print head may be assembled from multiple plates with features in all but the nozzle-defining plate being formed by photo-patterning and etching processes without machining or other metal working.

9 Claims, 19 Drawing Sheets

DROP-ON-DEMAND INK JET PRINT HEAD HAVING IMPROVED PURGING PERFORMANCE

This is a continuation of application Ser. No. 07/894,316 filed Jun. 4, 1992 now abandoned.

TECHNICAL FIELD

The present invention relates to an improved drop-on-demand ink jet print head and in particular to a compact ink jet print head incorporating multiple arrays of ink jets, each array receiving ink from an ink supply manifold having a tapered cross-sectional area.

BACKGROUND OF THE INVENTION

There have been known apparatus and methods for implementing multi-orifice drop-on-demand ink jet print heads. In general, each channel of a multi-orifice drop-on-demand ink jet operates by displacement of ink in an ink chamber and subsequent emission of ink droplets from the ink chamber through a nozzle. Ink is supplied from a common ink supply manifold through an ink inlet to the ink chamber. A driver mechanism is used to displace the ink in the ink chamber. The driver mechanism typically includes a transducer (e.g., a piezoceramic material) bonded to a thin diaphragm. When a voltage is applied to a transducer, the transducer displaces ink in the ink chamber, causing ink flow through the inlet from the ink manifold to the ink chamber and through an outlet and passageway to a nozzle. It is desirable to employ a geometry that permits multiple nozzles to be positioned in a densely packed array. The arrangement of the manifolds, inlets, and chambers and coupling the chambers to associated nozzles are not straightforward tasks, especially when compact ink jet array print heads are sought. Incorrect design choices, even in minor features, can cause non-uniform jetting performance.

Uniform jetting performance is generally accomplished by making the various features of each array channel in the ink jet print head substantially identical. Uniform jetting also depends on each channel being clear of contaminants and bubbles. Therefore, the various features of the multi-orifice print head must also be designed for effective purging.

An exemplary prior art ink jet print head construction is described in U.S. Pat. No. 4,680,595 of Cruz-Uribe, et al. FIGS. 1 and 4 of Cruz-Uribe et al. show two parallel rows of generally rectangular ink pressure chambers positioned with their centers aligned. The ink jet nozzles are coupled to different respective ink pressure chambers. The central axis of each nozzle extends normal to the plane containing the ink pressure chambers and intersects an extension portion of the ink pressure chamber. An ink manifold of substantially uniform cross-sectional area supplies ink to each of the chambers through a restrictive orifice that is carefully formed to match the nozzle orifice. Restrictive orifices are a form of ink inlet feature that acts to minimize acoustic cross-talk between adjacent channels of the multi-orifice array. However, such restrictions often trap contaminants or bubbles and, as a consequence, require frequent purging.

Effective purging depends on a relatively rapid ink flow rate through the various features of the head to "sweep away" contaminants or bubbles. Ink flow rate at various locations in the manifold depends on the number of "downstream" orifice channels being purged and the cross-sectional area of the manifold. The flow rate is, therefore, greater at the "upstream" end of the manifold than at the downstream end where only a single orifice channel is drawing ink. The ink flow rate at the downstream end of the manifolds may not be sufficient to sweep away contaminants or bubbles trapped in the manifolds.

U.S. Pat. No. 4,730,197 of Raman et al., which issued on a continuation application of the Cruz-Uribe et al. patent, describes additional embodiments thereof in FIGS. 11A and 11B including the same restrictor and ink manifold features.

U.S. Pat. No. 4,216,477 ("Matsuda et al. '477 patent") and U.S. Pat. No. 4,528,575 of Matsuda, et al. describe ink jet constructions in which ink is ejected parallel, instead of perpendicular, to the plane of the ink pressure chambers. In general, prior art array ink jet print heads in which the nozzle axes are parallel to the plane of the transducers are of relatively complex designs and, therefore, difficult to manufacture. Each orifice channel has a rectangular transducer coupled to an ink chamber that communicates through a passageway to a nozzle orifice. In at least some embodiments described in these patents, the passageways are of different lengths, depending upon the location of the transducer relative to its associated nozzle.

Both patents show ink supply manifolds that have essentially constant cross-sectional areas over their entire lengths. FIG. 1 of the Matsuda et al. '477 patent shows a print head oriented vertically having an ink manifold with an ink supply opening at the bottom. The top of the manifold extends beyond the upper most inlet to the upper most orifice channel forming an upper cavity in which bubbles, being less dense than ink, can be entrapped. During purging, little or no ink flows through the upper cavity, effectively preventing the purging of bubbles. Over time, additional entrapped bubbles can coalesce into a single large bubble that effectively blocks ink flow to an upper orifice channel. Moreover, entrapped bubbles have a resonant frequency and cause pressure pulses generated in a pressure chamber to be nonuniformly reflected back to inlets of adjacent pressure chambers. Entrapped bubbles also dissipate energy at certain frequencies. Therefore, entrapped bubbles contribute to non-uniform jetting.

U.S. Pat. No. 4,387,383 of Sayko describes a multi-orifice ink jet head. In FIG. 2, Sayko illustrates an ink manifold having a uniform cross-sectional area and in which the ink supply inlet is positioned at the top. Such a design minimizes entrapment of bubbles and facilitates their purgability but exacerbates the entrapment of contaminants that are more dense than the ink. The lack of sufficient ink flow rate at the bottom end of such a manifold prevents contaminants from being swept away during purging and leads to clogging of features in the lowermost orifice channels.

U.S. Pat. No. 4,521,788 of Kimura et al. describes a multi-orifice ink jet print head of radial construction with channel-to-channel feature uniformity that leads to uniform jetting performance. The radial ink supply manifolds of Kimura et al. illustrated in FIGS. 3, 6, and 7 are all of uniform cross-sectional area and include previously described features that can entrap contaminants or bubbles.

U.S. Pat. No. 4,367,480 of Kotoh describes a multi-orifice ink jet print head having uniform feature sizes in each orifice channel. FIG. 4 of Kotoh illustrates an ink manifold having a non-uniform cross-sectional area. However, the shape illustrated can entrap contaminants or bubbles. FIGS. 8 and 10 of Kotoh illustrate a nonuniform serpentine ink inlet configuration that provides uniform acoustic performance among orifice channels. Also shown is an ink supply manifold with ink inlets at both ends. Such a configuration allows cross-flow purging that is effective at removing contaminants or bubbles from such an ink manifold but not from the various features of each orifice channel. In addition, some compact head constructions do not have sufficient space for the additional manifold inlets required by cross-flow purging.

U.S. Pat. No. 5,087,930 of Roy et al. for DROP-ON-DEMAND INK JET PRINT HEAD, which is assigned to the assignee of the present application, describes a multi-orifice print head of compact design. Pertinent components of the Roy et al. patent are diagrammed in FIGS. 1A, 1B, 2, 3, and 4 of the present application. FIGS. 1A and 1B are exploded views of the laminated plate construction of a print head 1 that include a transducer receiving plate 2, a diaphragm plate 3, an ink pressure chamber plate 3, a separator plate 4, an ink inlet plate 5, a separator plate 6, an offset channel plate 7, an orifice separator plate 8, and an orifice plate 9. Plates 3 through 7 also form a set of black, yellow, magenta, and cyan ink manifolds. FIGS. 2–4 show each of the respective plates 5 through 7 in greater detail. In particular, a lower magenta ink manifold M is connected to the upper magenta ink manifold M' by an ink communication channel C. Ink is drawn as required from manifolds M and M' into multiple ink supply channels S, one for each magenta orifice channel of print head 1.

Referring to FIGS. 3 and 4, it has been discovered that, during periods of no printing a buoyant bubble B can become entrapped in an upper arch of ink communication channel C. During periods of printing, ink flows through channel C and manifold M' at a rate sufficient to drag bubble B to the inlet end of manifold M' but of insufficient rate to cause bubble B to be swept away through any of the ink supply channels S of print head 1. During purging, ink is caused to flow at an increased rate through manifolds M and M' and through ink supply channels S, causing bubble B to be drawn to a location B' at the right-hand end of manifold M'. However, bubble B' is not swept out of the rightmost end of manifold M' because only a single ink supply channel S' draws ink, resulting in a low ink flow rate. The buoyant force of bubble B', being greater than the ink flow rate-induced drag force on bubble B', causes bubble B' to remain entrapped. Moreover, entrapped bubble B' has a resonant frequency that acts to increase pressure pulse cross-talk among supply channels S within manifold M'whenever an ink orifice channel ejects ink drops at a rate near the resonant frequency of bubble B'. At some ejection rates, energy will be absorbed by the bubble, causing it to grow, which can lead to starvation of print head 1.

To make matters worse, during normal printing the position of bubble B' in manifold M' depends on the droplet ejection patterns and rates for the multiple ink supply channels S coupled to manifold M'. The resulting cross-talk and absorption induced jetting nonuniformities are visible in printed images as magenta intensity variations. Similar problems exist because of bubbles in the other manifolds of print head 1.

Although there are many prior art multi-orifice ink jet print head designs, a need exists for an improved ink jet print head that is compact, has uniform jetting characteristics, and is capable of being completely purged of contaminants or bubbles.

SUMMARY OF THE INVENTION

An object of this invention is, therefore, to provide a multi-orifice ink jet head that is capable of being completely purged of contaminants or bubbles.

Another object of the present invention is to provide an ink jet print head having individual jets that have substantially constant and identical ink drop jetting characteristics.

A further object of this invention is to provide a compact print head design having reduced cross-talk among orifice channels.

The present invention is a drop-on-demand ink jet print head that provides ink from a common ink supply manifold, through multiple inlets, and into a corresponding number of ink pressure chambers each of which is coupled to an acoustic transducer that causes controlled pressure waves in the ink. The pressure waves cause ink to flow through an ink outlet, into an offset channel, and through an orifice as droplets of ink ejected toward a print medium. The ink jet print head has a body that defines an ink supply manifold, ink inlets, ink pressure chambers, outlets, offset channels, and nozzle orifices. The ink jet print head is of a compact design having closely spaced nozzles.

The ink inlets to the pressure chambers and the ink outlets from the pressure chambers are diametrically or transversely opposed to provide the longest distance between them for acoustic isolation and cross flushing of the pressure chambers during normal operation and purging. To provide more uniform ink jetting characteristics, the ink jet head passages from the ink supply manifold to the ink pressure chambers and from the ink pressure chambers to the nozzles are each preferably of the same length and cross-sectional area so that the ink jetting characteristics of the ink pressure chambers, associated passages, and nozzles are substantially the same.

The ink jet print head has at least one tapered ink supply manifold and multiple ink supply channels that couple the tapered ink supply manifold to respective ink pressure chamber ink inlets. The ink supply channels are sized and the manifold is tapered to provide acoustic isolation between the ink pressure chambers and the manifold while still providing a sufficient ink flow at the highest print rates of the ink jet print head. Tapering the manifold provides a reduced cross-sectional area toward the downstream end of the manifold resulting in more uniform ink flow rate along the entire length of the manifold during printing and purging.

The ink jet print head is preferably formed of multiple flat plates that are held together to define the various chambers, passages, channels, nozzles, and manifolds of the ink jet print head.

Additional objects and advantages of this invention will be apparent from the following detailed description of a preferred embodiment thereof which proceeds with reference to the accompanying drawings.

DETAILED DESCRIPTION OF PREFERRED EMBODIMENT

Figure 1A:
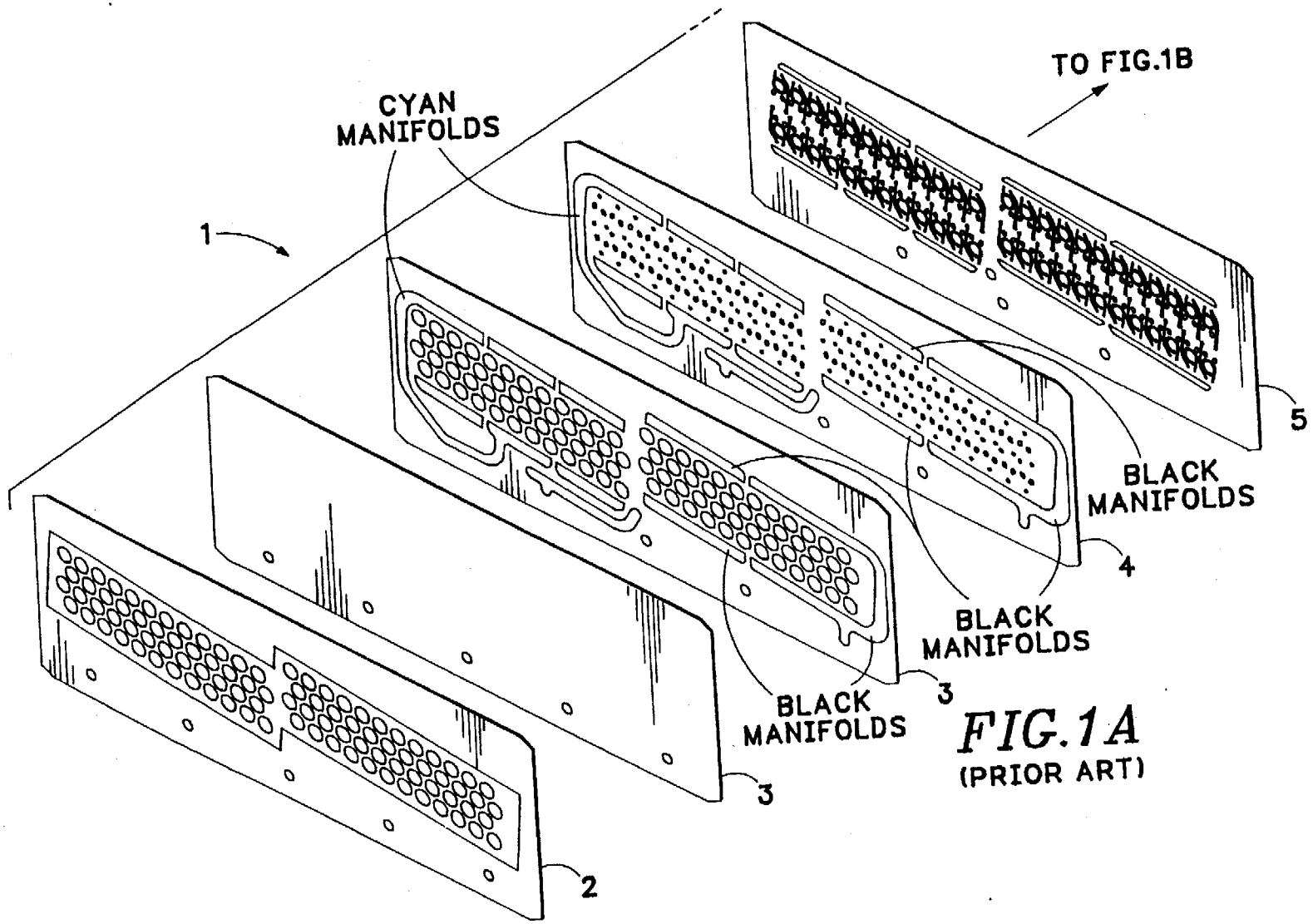
FIG. 1A (PRIOR ART)
FIGS. 1A and 1B together form an exploded isometric view of the various layers of a prior art array-type ink jet print head having two arrays of forty-eight nozzles each.
Figure 1B:
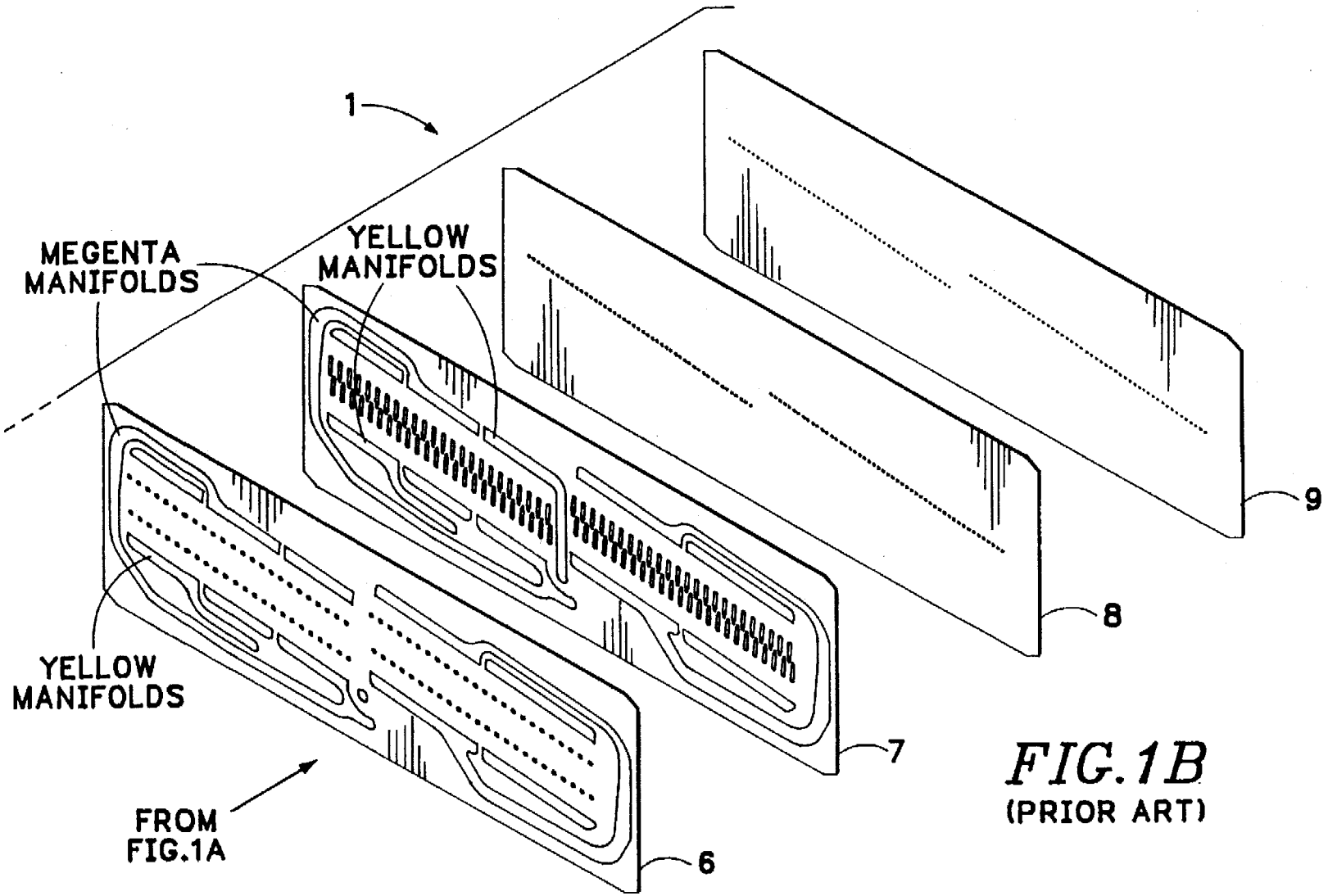
FIG. 1B (PRIOR ART)
Figure 2:
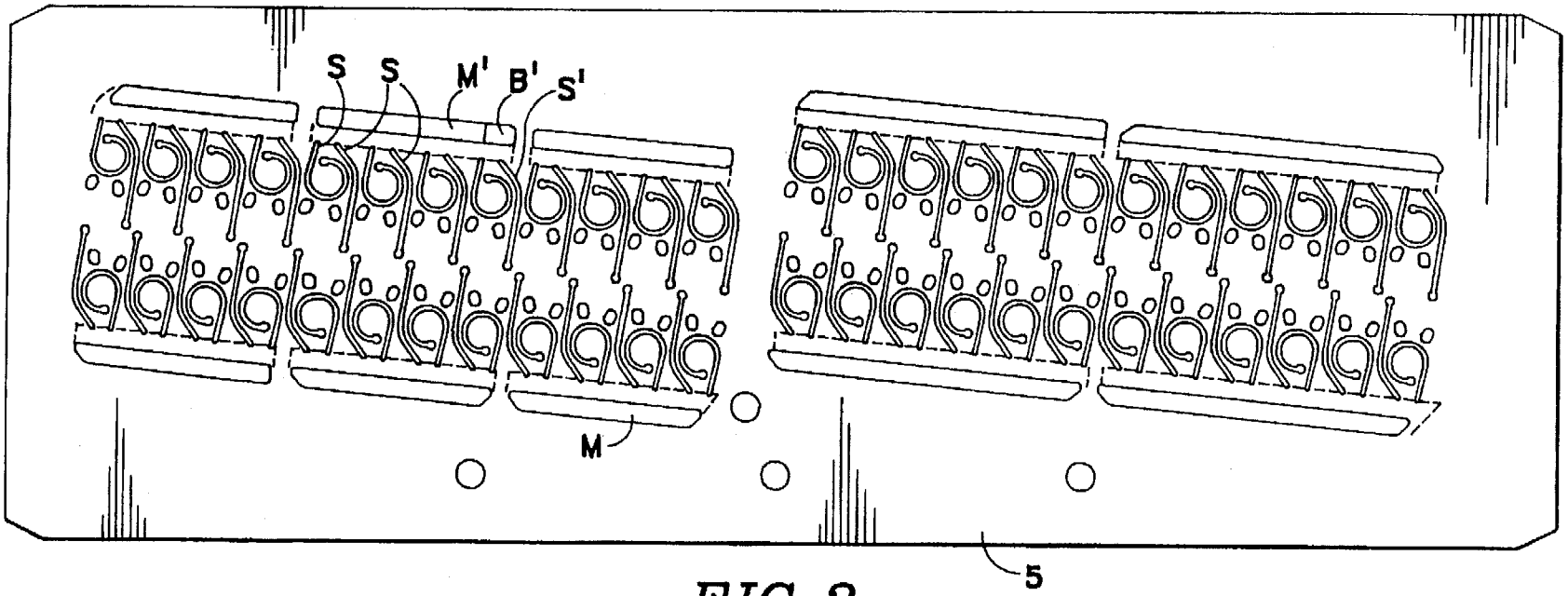
FIG. 2 (PRIOR ART)
FIGS. 2–4 are enlarged frontal views of representative plates forming the ink manifolds and ink inlet channels of the prior art ink jet head illustrated in FIGS. 1A and 1B, with portions of the manifolds shown in FIGS. 3 and 4 shown as broken lines in FIG. 2.
Figure 3:
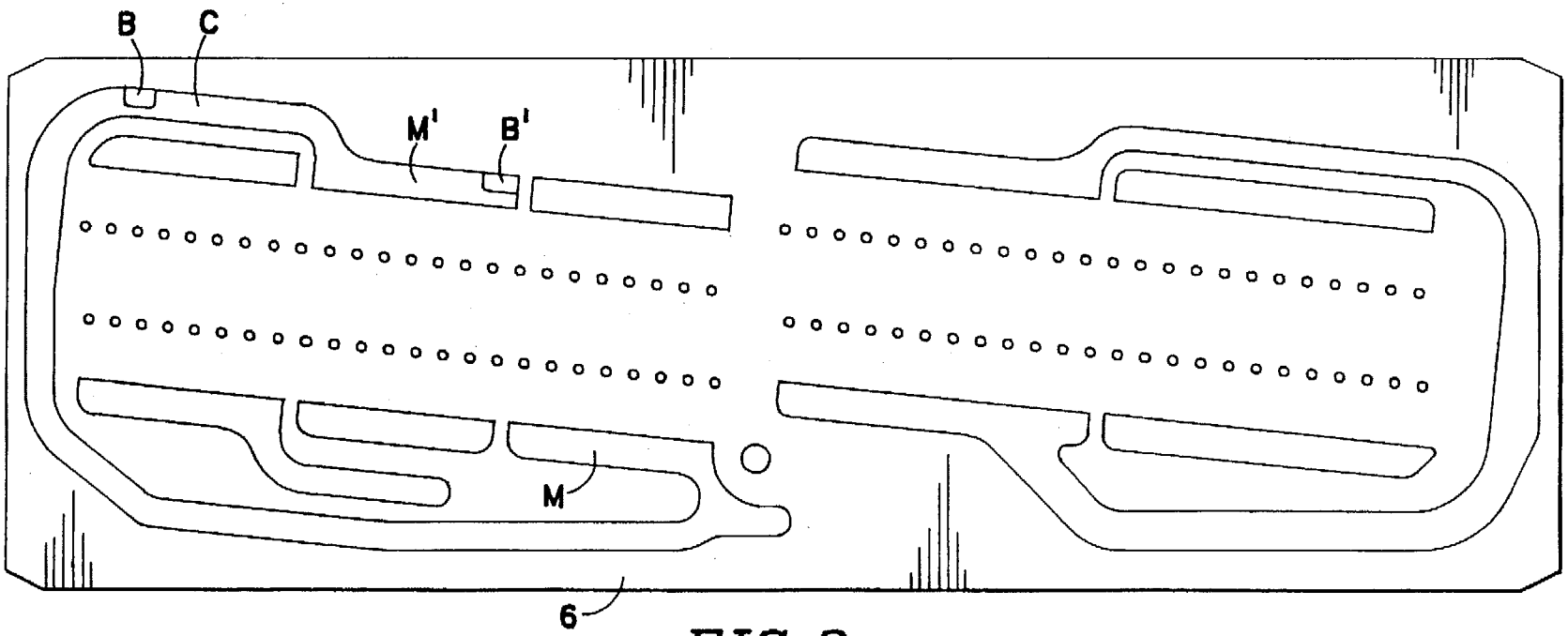
FIG. 3 (PRIOR ART)
Figure 4:
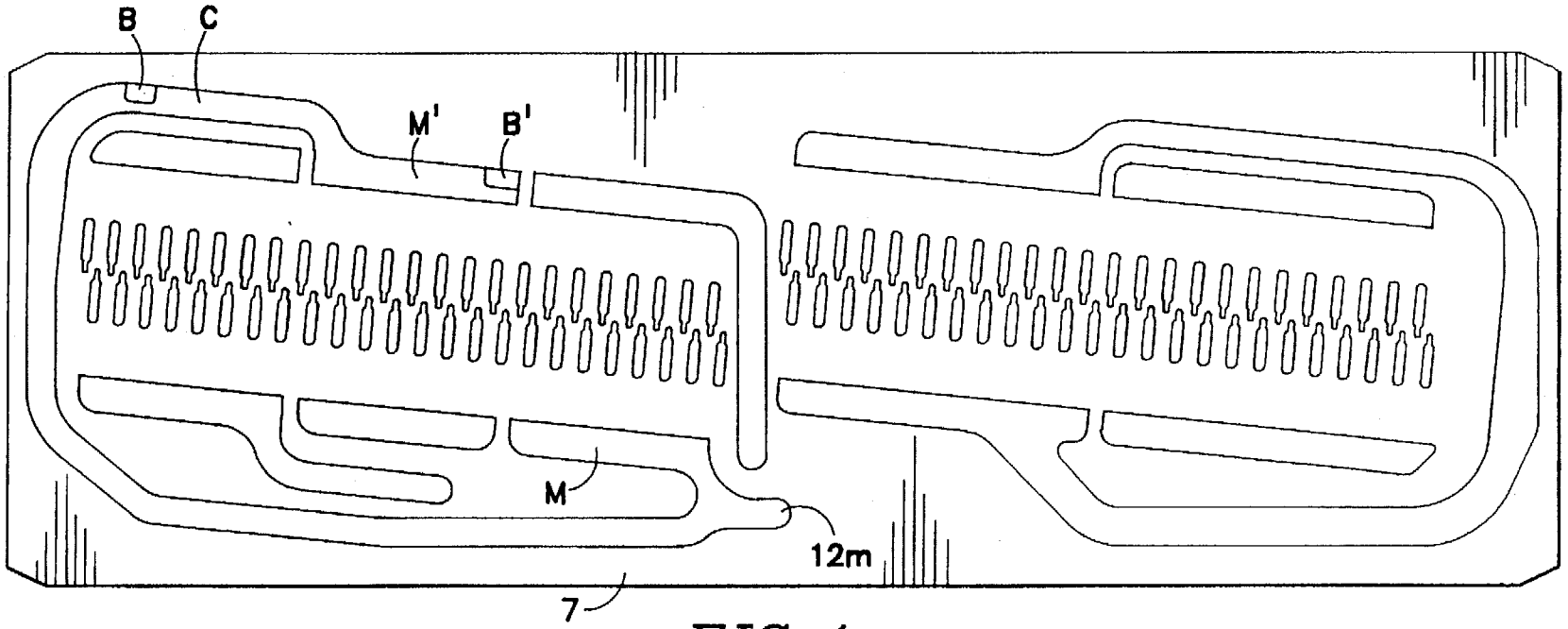
FIG. 4 (PRIOR ART)

The print head of the present invention responds to a need for a drop-on-demand ink jet array print head that incorporates a compact array of ink drop-forming nozzles, each selectively driven by an associated driver, such as by a piezoceramic transducer mechanism. The design considerations for such a print head are explained with reference to the following example. An ink jet print head used in a typewriter-like print engine vertically advances a print medium on a curved surface past a spaced-apart print head that shuttles back and forth and prints in both directions during shuttling. It is desirable to provide such a print head with an array of nozzles that span the minimum possible vertical distance so as to minimize the variation in distance between them and the print medium.

It is also desirable to provide a print head that spans the minimum horizontal distance. The portion of a print head that prints with 48 jets at 118 lines/centimeter (300 lines/inch) both horizontally and vertically, for example, would have a vertical row of 48 nozzles that span 47/118 centimeter (47/300 inch) from the centers of the first and last nozzles. In this configuration, each nozzle could address the left-most as well as the right-most address location on the print medium without overscan. Any horizontal displacement of the nozzles requires overscan at both the left and right margins by at least the amount of this displacement so that all of the print medium locations can be addressed. Overscanning increases both the print time and the overall width of the printer. Minimizing the horizontal spacing between nozzles helps reduce the print time and the printer width. Because the transverse dimensions of the pressure transducers required for jets of the type described here are many times larger than the vertical nozzle-to-nozzle spacing, a certain amount of horizontal displacement of the nozzles is necessary, the amount being dictated by the size of the transducers and their geometric arrangement. An objective is to minimize this displacement.

One approach for minimizing the horizontal spacing of nozzles is to allow no features within the boundaries of the array of ink pressure chambers or pressure transducers. All other features would be either outside the boundary of the array of these transducers or pressure chambers if they are in the plane of these components or placed in planes above (farther from the nozzles) or below (closer to the nozzles) these components. For example, all electrical connections to the transducers can be made in a plane above the pressure transducers and all inlet passages, offset channel passages, outlet passages, and nozzles can be in planes below the ink pressure chambers and pressure transducers. Wherever two of these types of features would interfere with each other geometrically if they were placed in the same plane, they are placed in different planes from each other so that the horizontal displacement of the nozzles is controlled only by how closely the pressure transducers or pressure chambers can be positioned. For example, the inlet passages can be in a different plane from that of the offset channel passages and the offset channel passages can be in a different plane from that of the outlet passages. Thus, to minimize the horizontal and vertical dimensions of the array of nozzles, extra layers are added, resulting in an increase of the thickness of the print head.

Integrated electronic driver circuits are generally less expensive than those made from individual components and are even less expensive if all of the integrated circuit drivers are triggered simultaneously. Thus, if the nozzles of the print head cannot be arranged in a vertical line, then the horizontal displacement between one nozzle and any other should be some integer multiple of the vertical nozzle-to-nozzle spacing if inexpensive driver circuits are to be used. If more than one driver circuit is to be used, then this requirement is relaxed, but all of the nozzles driven by a single integrated circuit should still be spaced apart in the horizontal direction by integer multiples of the vertical nozzle-to-nozzle spacing. It is also desirable to have a compact print head that has low drive voltage requirements, is capable of operating at a high ink drop ejection rate, is relatively inexpensive to fabricate, and can print multiple colors of ink.

Figure 5:
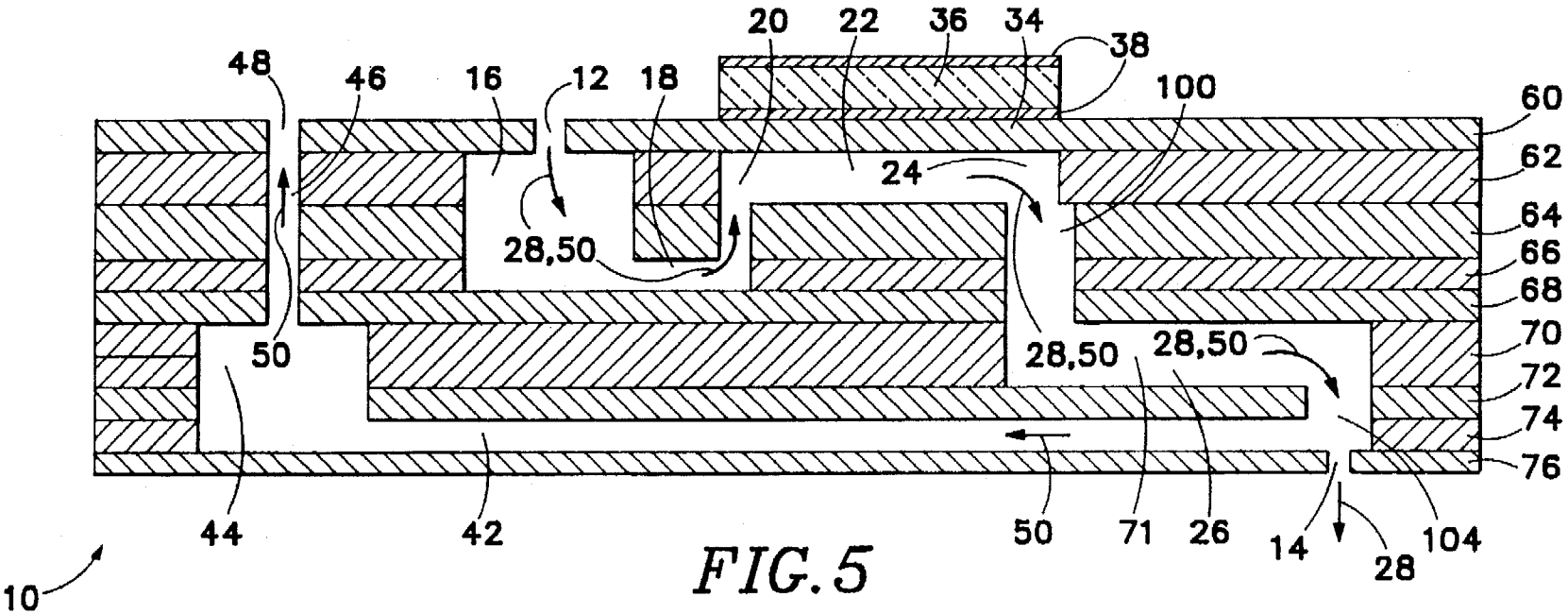
FIG. 5 is a diagrammatic cross-sectional view of a single ink jet of the type included in an array jet print head of the present invention.

Referring to FIG. 5, a cross-sectional view of one orifice channel of a multi-orifice ink jet print head according to the invention is shown having a body 10 which defines an ink inlet 12 through which ink is delivered to the ink jet print head. The body also defines an ink drop forming orifice outlet or nozzle 14 together with an ink flow path from the ink inlet 12 to the nozzle. In general, the ink jet print head of the present invention preferably includes an array of nozzles 14 which are closely spaced from one another for use in printing drops of ink onto a print medium (not shown).

Ink entering ink inlet 12 flows into a tapered ink supply manifold 16 (tapering not shown in FIG. 5). A typical ink jet print head has at least four such manifolds for receiving, black, cyan, magenta, and yellow ink for use in black plus three-color subtraction printing. However, the number of such manifolds may be varied depending upon whether a printer is designed to print solely in black ink or with less than a full range of color. Ink flows from tapered ink supply manifold 16, through an ink supply channel 18, through an ink inlet 20, and into an ink pressure chamber 22. Ink leaves the pressure chamber 22 by way of an ink pressure chamber outlet 24 and flows through an ink passage 26 to nozzle 14, from which ink drops are ejected. Arrows 28 diagram the just-described ink flow path.

Ink pressure chamber 22 is bounded on one side by a flexible diaphragm 34. The pressure transducer in this case is a piezoelectric ceramic disc 36 secured to diaphragm 34 by epoxy and overlays ink pressure chamber 22. In a conventional manner, ceramic disc transducer 36 has metal film layers 38 to which an electronic circuit driver, not shown, is electrically connected. Although other forms of pressure transducers may be used, ceramic disc transducer 36 is operated in its bending mode such that when a voltage is applied across metal film layers 38, ceramic disc transducer 36 attempts to change its dimensions. However, because it is securely and rigidly attached to the diaphragm, ceramic disc transducer 36 bends and thereby displaces ink in ink pressure chamber 22, causing the outward flow of ink through passage 26 to nozzle 14. Refill of ink chamber 22 following the ejection of an ink drop can be augmented by reverse bending of ceramic disc transducer 36.

In addition to the main ink flow path 28 described above, an optional ink purging channel 42 is defined by the ink chamber body 10. Purging channel 42 is coupled to ink passage 26 at a location adjacent to, but interiorly of nozzle 14. Purging channel 42 communicates from ink passage 26 to a purging manifold 44 that is connected by an outlet passage 46 to a purging outlet port 48. Purging manifold 44 is typically connected by similar purging channels 42 to the passages associated with multiple nozzles. During a purging operation, ink flows through body 10 in a direction indicated by arrows 50. The direction and rate of ink flow through nozzle 14 during purging depends on relative pressure levels at ink inlet 12, nozzle 14, and purging outlet port 48. Purging is described in more detail below.

To facilitate manufacture of the ink jet print head of the present invention, body 10 is preferably formed of multiple laminated plates or sheets, such as of stainless steel. These sheets are stacked in a superimposed relationship. In the illustrated FIG. 5 embodiment of the present invention, these sheets or plates include a diaphragm plate 60, which forms diaphragm 34, ink inlet 12, and purging outlet 48; an ink pressure chamber plate 62, which defines ink pressure chamber 22, a portion of ink supply manifold 16, and a portion of purging passage 48; a separator plate 64, which defines a portion of ink passage 26, bounds one side of ink pressure chamber 22, defines inlet 20 and outlet 24 to ink pressure chamber 22, defines a portion of ink supply manifold 16, and defines a portion of purging passage 46; an ink inlet plate 66, which defines a portion of passage 26, inlet channel 18, and a portion of purging passage 46; another separator plate 68, which defines portions of passages 26 and 46; an offset channel plate 70, which defines a major or offset portion 71 of passage 26 and a portion of purging manifold 44; a separator plate 72, which defines portions of passage 26 and purging manifold 44; an outlet plate 74, which defines purging channel 42 and a portion of purging manifold 44; and a nozzle plate 76, which defines nozzles 14 of the array.

More or fewer plates than those illustrated may be used to define the various ink flow passageways, manifolds, and pressure chambers of the ink jet print head of the present invention. For example, multiple plates may be used to define an ink pressure chamber instead of the single plate illustrated in FIG. 5. Also, not all of the various features need be in separate sheets or layers of metal. For example, patterns in the photoresist that are used as templates for chemically etching the metal (if chemical etching is used in manufacturing) could be different on each side of a metal sheet. Thus, as a more specific example, the pattern for the ink inlet passage could be placed on one side of the metal sheet while the pattern for the pressure chamber could be placed on the other side and in registration front-to-back. Thus, with carefully controlled etching, separate ink inlet passage and pressure chamber containing layers could be combined into one common layer.

To minimize fabrication costs, all of the metal layers of the ink jet print head, except nozzle plate 76, are designed so that they may be fabricated using relatively inexpensive conventional photo-patterning and etching processes in metal sheet stock. Machining or other metal working processes are not required. Nozzle plate 76 has been made successfully using any number of various processes, including electroforming from a sulfumate nickel bath, microelectric discharge machining in three hundred series stainless steel, and punching three hundred series stainless steel, the last two approaches being used in concert with photo-patterning and etching all of the features of the nozzle plate except the nozzles themselves. Another suitable approach is to punch the nozzles and to use a standard blanking process to form the rest of the features in this plate.

The print head of the present invention is designed so that layer-to-layer alignment is not critical in that tolerances typically held in a chemical etching process are adequate. The various layers forming the ink jet print head of the present invention may be aligned and bonded in any suitable manner, including the use of suitable mechanical fasteners. However, a preferred approach for bonding the metal layers is described in U.S. Pat. No. 4,883,219 of Anderson, et al. for MANUFACTURE 0F INK JET PRINT HEADS BY DIFFUSION BONDING AND BRAZING, which is assigned to the assignee of the present application. This bonding process is hermetic, produces high strength bonds between the parts, leaves no visible fillets to plug the small channels in the print head, does not distort the features of the print head, and yields an extremely high percentage (almost 100%) of satisfactory print heads. This manufacturing process can be implemented with standard plating equipment, standard furnaces, and simple diffusion bonding fixtures, and can take fewer than three hours from start to finish for the complete bonding cycle, while many ink jet print heads are simultaneously manufactured. In addition, the plated metal is so thin that essentially all of it diffuses into the stainless steel during the brazing step so that none of it is left to interact with the ink, either to be attacked chemically or by electrolysis. Therefore, plating materials, such as copper, that are readily attacked by some inks may be used in this bonding process.

The electromechanical transducer mechanism selected for the ink jet print heads of the present invention can comprise ceramic disc transducers 36 bonded with epoxy to the metal diaphragm plate 60, with each of the discs centered over a respective ink pressure chamber 22. For this type of transducer mechanism, a substantially circular shape has the highest electromechanical efficiency, which refers to the volume displacement for a given area of the piezoceramic element. Thus, transducers of this type are more efficient than rectangular type, bending mode transducers.

To provide an extremely compact and easily manufacturable ink jet print head, the various pressure chambers 22 are generally planar in that they are much larger in transverse cross-sectional dimension than in depth. This configuration results in a higher pressure for a given displacement of the transducer into the volume of pressure chambers 22. Moreover, all of ink jet pressure chambers 22 of the ink jet print head of the present invention are preferably, although not necessarily, located in the same plane or at the same depth within the ink jet print head. This plane is defined by the plane of one or more plates 62 used to define these pressure chambers.

Figure 6:
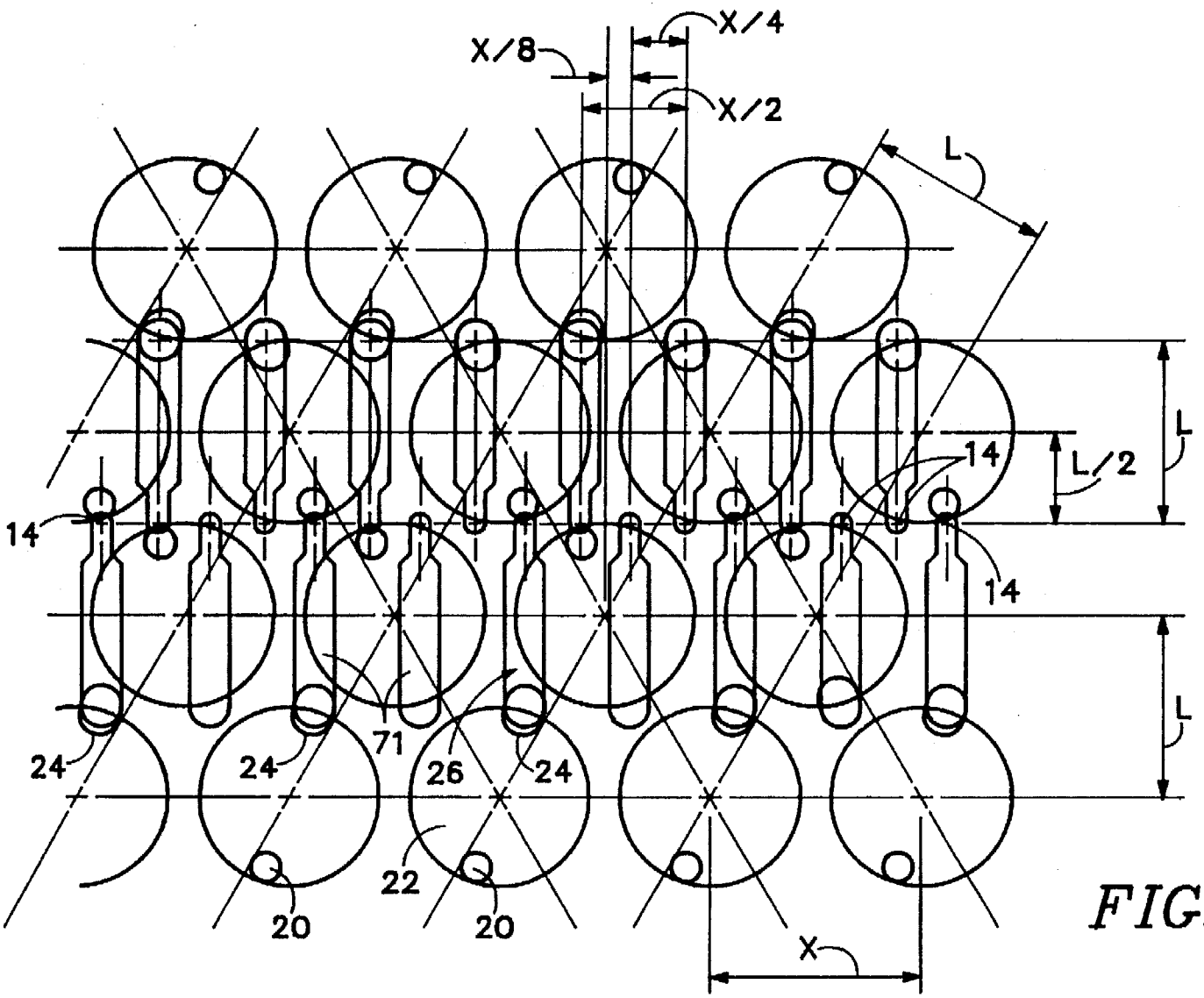
FIG. 6 is an enlarged schematic overlay view showing the transverse spacings and orientations of ink pressure chambers, ink inlet and outlet passageways, and offset channels of an ink jet head according to this invention.

In order to achieve an extremely high packing density, ink pressure chambers 22 are arranged in parallel rows with their geometric centers offset or staggered from one another. Also, pressure chambers 22 are typically separated by very little sheet material. In general, only enough sheet material remains between the pressure chambers as is required to accomplish reliable (leak-free) bonding of the ink pressure defining layers to adjacent layers. As shown in FIG. 6, a preferred arrangement comprises four parallel rows of pressure chambers 22 having a diameter L with the centers of the chambers of one row offset from the centers of the chambers of an adjacent row. In particular, with circular pressure chambers, the four parallel rows or pressure chambers are offset so that their geometric centers, if interconnected by lines, would form a hexagonal array. The centers of pressure chambers 22 may be located in a grid or array of irregular hexagons, but the most compact configuration is achieved with a grid of regular hexagons. This grid may be extended indefinitely in any direction to increase the number of ink pressure chambers and nozzles in a particular ink jet print head.

In general, for reasons of efficient operation, it is preferable that pressure chambers 22 have a transverse cross-sectional dimension that is substantially equal in all directions. Hence, substantially circular pressure chambers have been found to be most efficient. However, other configurations such as pressure chambers having a substantially hexagonal cross-section, and thus having substantially equal transverse cross-sectional dimensions in all directions, would also be efficient. Pressure chambers having other cross-sectional dimensions may also be used, but those with substantially the same uniform transverse cross-sectional dimension in all directions are preferred.

Piezoceramic discs 36 are typically no more than 0.254 millimeter (0.010 inch) thick, but they may be either thicker or thinner. While ideally these disks would be circular to conform to the shape of the circular ink pressure chambers, little increase in drive voltage is required if these disks are made hexagonal. Therefore, the disks can be cut from a large slab of material using, for example, a circular saw. The diameter of the inscribed circle of these hexagonal piezoceramic disks 36 is typically several thousandths of a centimeter less than the diameter of the associated pressure chamber 22 while the circumscribed circle of these disks is several thousandths of a centimeter larger. Diaphragm layer 60 is typically no more than 0.1 millimeter (0,004 inch) thick.

FIG. 6 also illustrates the arrangement wherein ink inlets 20 to pressure chambers 22 and ink outlets 24 from pressure chambers 22 are diametrically opposed. These diametrically opposed inlets and outlets provide cross flushing of the pressure chambers during filling and purging to facilitate the sweeping of contaminants or bubbles from pressure chambers 22. This arrangement of inlets 20 and outlets 24 also provides the largest separation of inlets and outlets for enhanced acoustic isolation.

Thus, with the illustrated construction, the nozzles may be arranged with center-to-center spacings that are much closer than the center-to-center spacings of closely spaced and associated pressure chambers. For example, assuming the horizontal center-to-center spacing of the pressure chambers is X, the spacing of the associated nozzles is one-fourth X. For purposes of symmetry it is preferable that the nozzle-to-nozzle spacing in a row of nozzles is the inverse of the number of rows of ink pressure chambers supplying the row of nozzles. Thus, for example, if there were six rows of ink pressure chambers supplying one row of nozzles, the nozzle-to-nozzle spacing would be one-sixth X. Consequently, an extremely compact ink jet print head is provided with closely spaced nozzles. As a specific example of the compact nature of ink jet print heads of the present invention, a 96 nozzle array jet of FIG. 6 is about 9.65 centimeters (3.8 inches) long by 3.3 centimeters (1.3 inch) wide by 0.18 centimeters (0.07 inch) thick.

Bubbles are readily formed when using hot melt inks in compact print heads such as the one just described. Hot melt inks shrink when "frozen" at room temperature, drawing air through the orifices into the print head. Bubbles also form from gasses dissolved in hot melt ink as it freezes in internal features of the print head such as the pressure chambers, passages, and manifolds. Therefore, as shown in FIG. 5, purging channels 42 connect purging manifolds 44 to the nozzles 14. These optional channels and manifolds are used during initial jet filling, initial heating of previously frozen hot melt ink, and during purging to remove contaminants or bubbles. Purging manifolds 44 may also be tapered to improve their purgability. A valve, not shown, is used to close the purging outlet 48 and thus the purging flow path 50 when not being used. U.S. Pat. No. 4,727,378 of Le et al. discloses in greater detail one possible use of such a purging outlet. Elimination of the purging channels and outlets reduces the thickness of the ink jet print head in the preferred embodiment by eliminating the plates used in defining these features of the print head.

Figure 7:
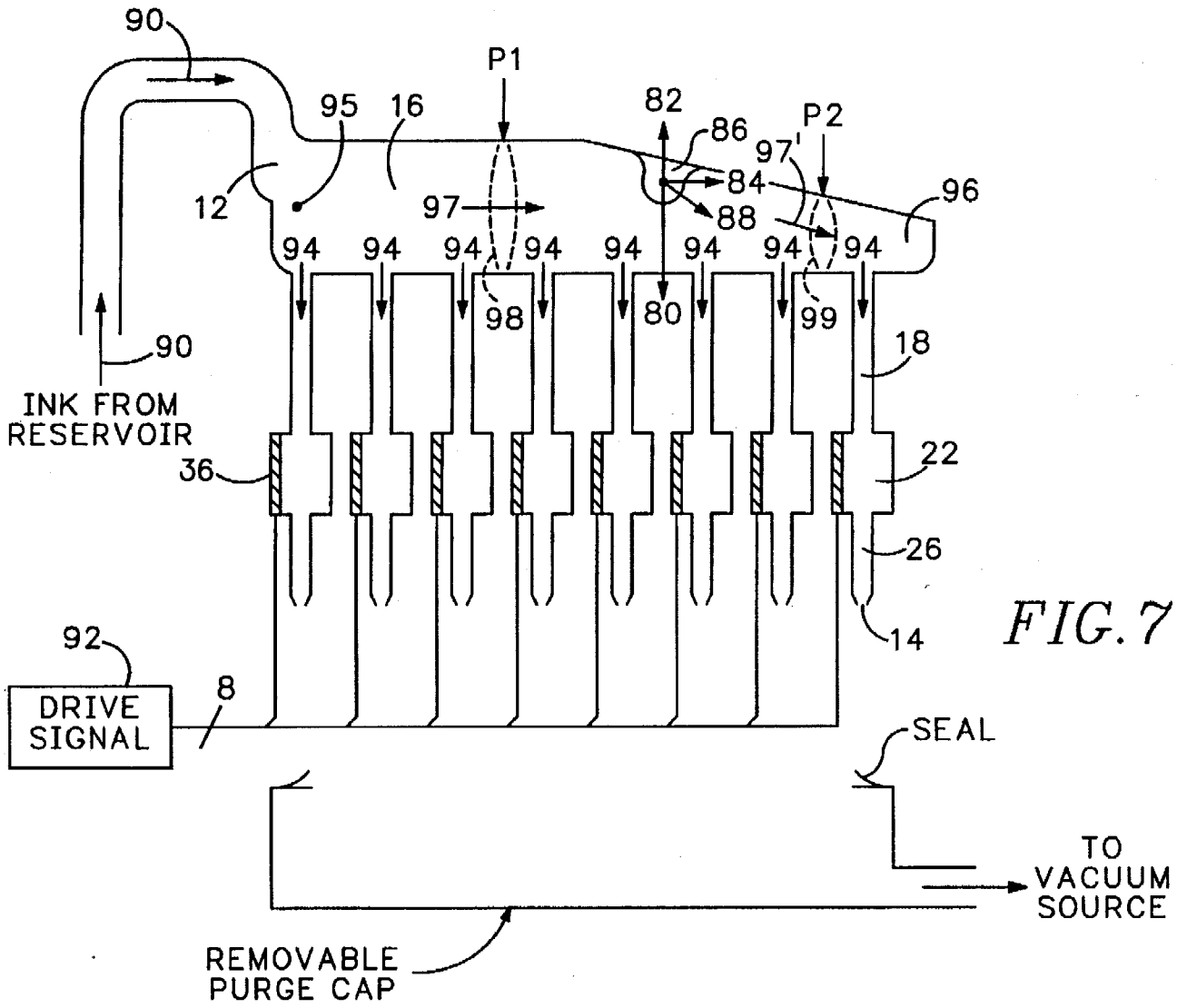
FIG. 7 is a simplified pictorial schematic view of an ink jet system according to one embodiment of this invention showing various forces acting on a bubble in a cross-sectionally tapered manifold.

Referring to FIG. 7, a diagram of an ink jet system shows arrows representing the directions of a gravitational force 80, a buoyant force 82, and an ink flow rate-induced force 84 acting on a bubble 86 present in tapered manifold 16. The forces coact to form a resultant force 88 that causes bubble 86 to move within tapered manifold 16 in the direction of resultant force 88. Experience indicates that gravitational force 80 and buoyant force 82 are substantially constant, making ink flow rate-induced force 84 have the dominant variable effect on resultant force 88.

In operation, ink is supplied from a reservoir (not shown) through ink inlet 12 to tapered reservoir 16 at a given inlet flow rate at a location indicated by an arrow 90. A drive signal source 92 selectively drives multiple transducers 36 (eight shown) causing ink to be drawn through ink supply channels 18, into ink pressure chambers 22, through ink passages 26, and ejected from nozzles 14. The flow rate of the supply channel ink at the locations indicated by arrows 94 (eight channels shown) depends on the electrical drive waveform with which drive signal source 92 separately drives each of ceramic disc transducers 36. Drive signal source 92 can provide to each ceramic disc transducer 36 substantially identical drive waveforms to effect equal jetting characteristics for each separate nozzle. The equal jetting characteristics stem from the acoustically equivalent design of similar features of the separate orifice channels.

During purging, a vacuum source (not shown) is placed in contact with nozzles 14 to cause substantially the same channel ink flow rate at the locations of arrows 94 simultaneously through all ink supply channels 18, ink pressure chambers 22, ink passages 26, and nozzles 14. Co-pending U.S. Pat. App. No. 07/688,758 of MacLane et al, now U.S. Pat. No. 5,184,147 issued Feb. 2, 1992 hereby specifically incorporated by reference in pertinent part for an INK JET HEAD MAINTENANCE SYSTEM, which is assigned to the assignee of this application, describes one such vacuum purging system.

The ink flow rate at arrow 90 at ink inlet 12 depends on the sum of all channel ink flow rates of arrows 94 (eight channels shown) and depends inversely on the cross-sectional area of ink inlet 12. Tapered manifold 16 has a first end 95 located upstream and adjacent to the nearest upstream one of ink supply channels 18 and a second end 96 located downstream and adjacent to the farthest downstream one of ink supply channels 18. At a point P1 within tapered manifold 16, a manifold ink flow rate at the location of arrow 97 depends on the sum of five downstream channel flow rates at arrows 94 and depends inversely on a cross-sectional area 98 of tapered manifold 16. At point P2, near the far downstream end of tapered manifold 16, a manifold ink flow rate at the location of arrow 97' depends only on one ink channel flow. rate at arrow 94 and depends inversely on a cross-sectional area 99 of tapered manifold 16. Cross-sectional area 99 is therefore sized smaller than cross-sectional area 98 to compensate for differences in manifold ink flow rates at arrows 97 and 97'. This causes the ink flow rate at arrow 97' to produce a resultant force 88 on bubble 86 that is sufficient to overcome buoyant force 82 when bubble 86 is at point P2 in tapered manifold 16. Such a tapered manifold design causes sufficient resultant force 88 on bubble 86 at any point between first end 95 and second end 96 of tapered manifold 16, thereby rendering the ink jet system completely purgable.

A continuous linear taper of the cross-sectional area of tapered manifold 16 is preferred. The taper does not have to be linear, but should avoid discontinuities that entrap bubbles and contaminants. Furthermore, the taper is preferably applied only to a downstream portion of tapered manifold 16 to balance manifold ink volume requirements with purging flow rate requirements. Such a partial taper also improves the acoustic isolation properties of tapered manifold 16.

In a manner similar to that for bubbles, ink flow rate-induced force 84 acts on contaminants that are more dense than the ink. A tapered manifold design such as that shown in FIG. 7, if inverted, is operable to purge dense contaminants from such an ink jet system. In the preferred form of this invention, only the non-inverted, bubble purging system of FIG. 7 has been employed to prevent contaminants from damaging the nozzles, but the invention is not limited to one form or the other. Likewise, the invention applies equally to "reverse purging" and "back flushing" type of purging in which the ink flow is in a direction opposite to that shown and described herein.

Figure 8A:
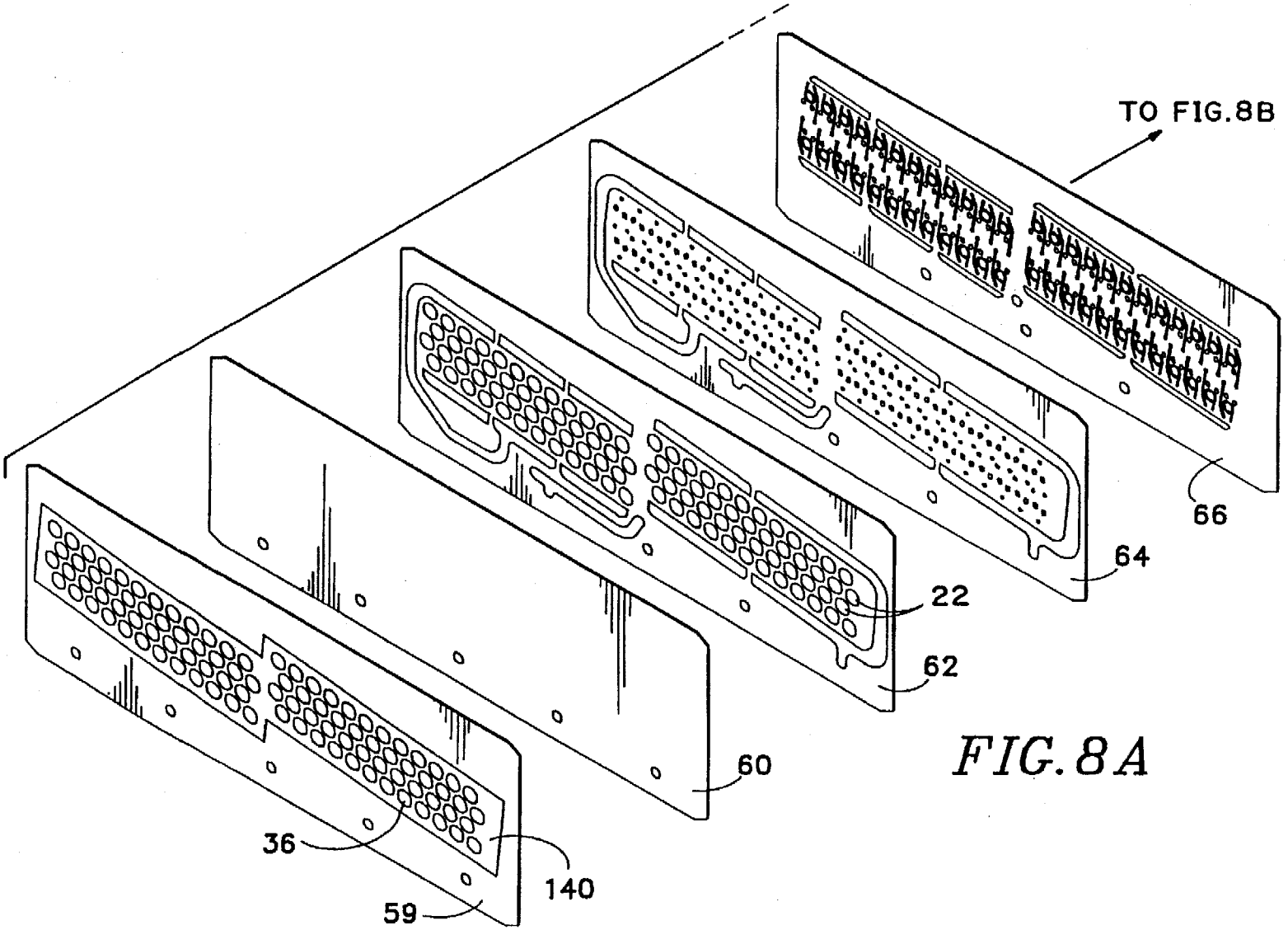
FIGS. 8A and 8B together form an exploded isometric view of the various layers of an array-type ink jet print head array having two arrays of forty-eight nozzles each in accordance with one embodiment of this invention.
Figure 8B:
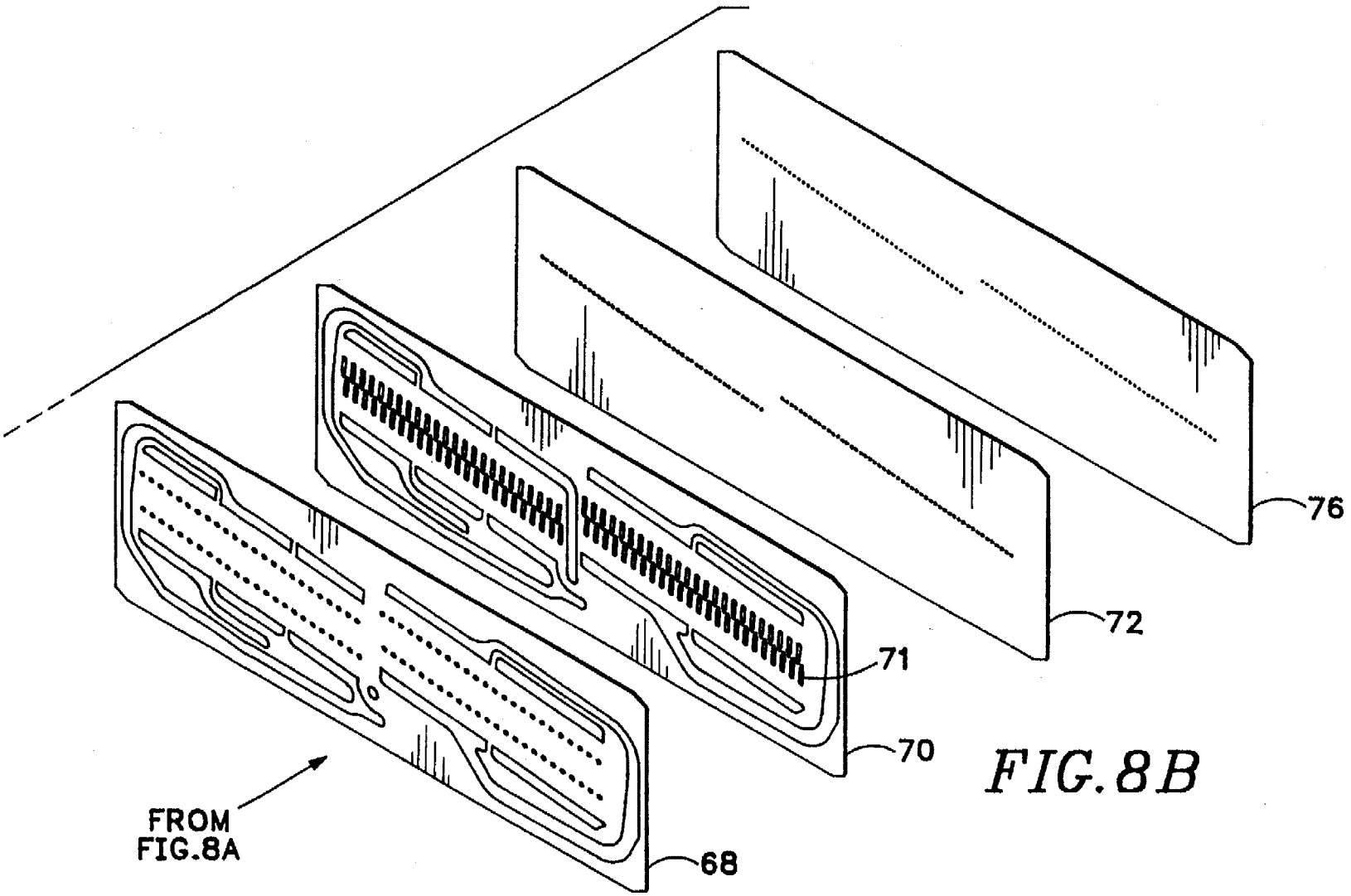
Figure 13:
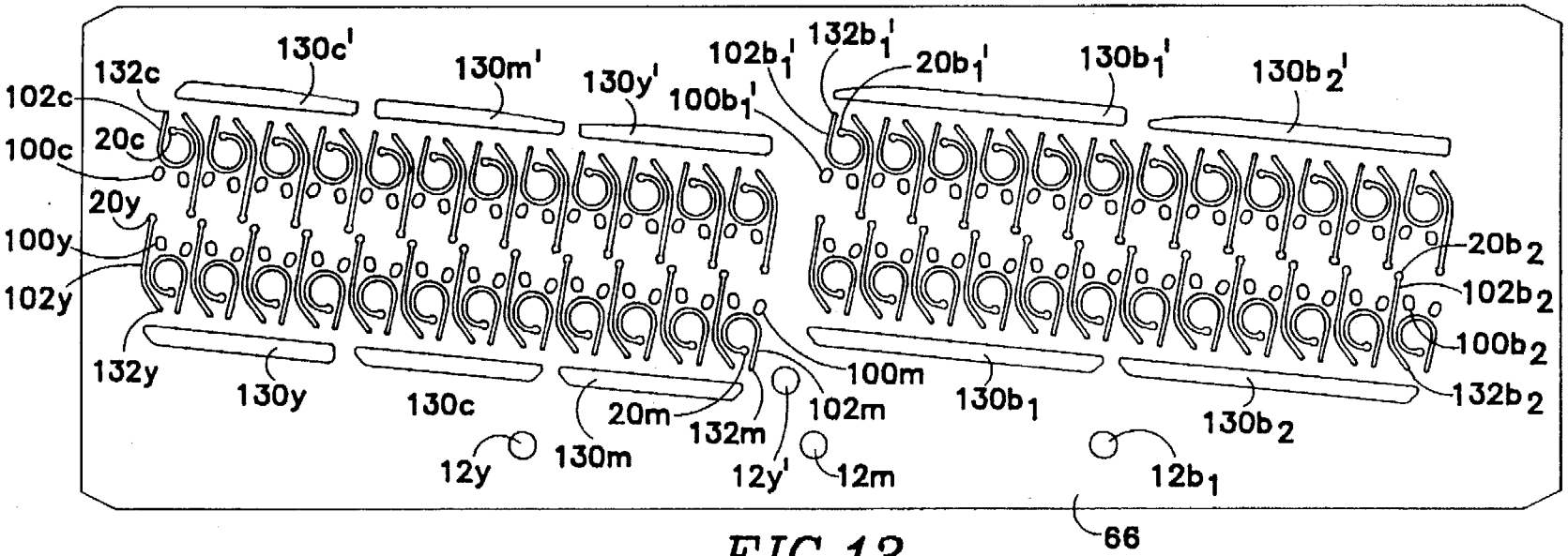

Referring to FIGS. 5, 8, and 13, the illustrated. ink jet print head has four rows of pressure chambers. To eliminate the need for ink supply inlets to the two inner rows of pressure chambers from passing between the pressure chambers of the outer two rows of jets, which would thereby increase the required spacing between the pressure chambers, ink supply inlets pass to the pressure chambers in a plane located beneath the pressure chambers. That is, the supply inlets extend from the exterior of the ink jet to a location in a plane between the pressure chambers and nozzles. The ink supply channels then extend to locations in alignment with the respective pressure chambers and are coupled thereto from the underside of the pressure chambers.

To provide equal fluid impedances for inlet channels to the inner and outer rows of pressure channels, the inlet channels can be made in two different configurations that have the same cross-section and same overall length. The length of the inlet channels and their cross-sectional area determine their characteristic impedance, which is chosen to provide the desired performance of these jets and which avoids the use of small orifices or nozzles at inlet 20 to pressure chambers 22. Typical inlet channel dimensions are 7 millimeters (0.275 inch) long by 0.25 millimeter (0.01 inch) wide and vary from 0.1 millimeter (0.004 inch) thick to 0.4 millimeter (0.016 inch) thick, depending upon the viscosity of the ink. Ink viscosity typically varies from about one centipoise for aqueous inks to about ten to thirty centipoise for hot melt inks. The inlets are sized to supply sufficient ink for operation at the desired maximum ink jet printing rate while still providing satisfactory acoustic isolation of the ink pressure chambers.

The inlet and outlet manifolds are preferably situated outside of the boundaries of the four rows of pressure chambers. In addition, the cross-sectional dimensions of the ink inlet manifolds are sized and tapered to contain the smallest volume of ink and yet supply sufficient ink to the jets when all of the ink jets are simultaneously operating and to provide sufficient compliance to minimize jet-to-jet cross-talk. As described above, the ink flow rate at any point in the manifolds depends on the number of orifice channels drawing ink downstream of that point in the manifolds. Tapering the inlet manifolds by decreasing their cross-sectional areas as a function of the number of orifice channels downstream of various points in the manifolds regulates the ink flow rate. Therefore, during purging, the flow rate at any point in the manifolds is sufficiently high to sweep contaminants or bubbles from the manifolds.

Although multiple ink supply channels are supplied with ink from each manifold, acoustic isolation between the ink chambers coupled to a common manifold is achieved in the present design. This is so because with the above-described construction, the ink supply manifolds and ink supply channels function as a acoustic resistance-capacitance circuits that dampen pressure pulses. These pressure pulses otherwise could travel back through the inlet channel from the pressure chamber in which they were originated, pass into the common manifold, and then into adjacent inlet channels to adversely affect the performance of adjacent jets.

In the present invention, the tapered manifolds provide compliance and the inlet channels provide acoustic resistance such that the pressure chambers are acoustically isolated from one another. Tapering the manifolds improves their purgability and eliminates entrapment of bubbles that can reduce the acoustic isolation and balanced performance among jets. Tapering the manifolds also creates more randomized acoustic reflection paths within the manifolds that tend to improve the acoustic isolation. The term acoustic isolation means that the ink drop ejection characteristics of one jet is not effected by the operation of any other ink jet or jets connected to the same manifold.

The ink jet print head illustrated in FIG. 8 has a row of 48 nozzles that are used to print black ink. This ink jet print head also has a separate, horizontally offset row of 48 nozzles that are used to print colored ink. Sixteen of the latter row of 48 nozzles are used for cyan ink, sixteen for magenta ink, and 16 for yellow ink.

The ink jet print head layout of FIG. 8 can be readily modified to have nozzles on a single line rather than a dual line. None of the operating characteristics of the ink jet print head would be affected by this modification.

FIGS. 9 through 17 illustrate, respectively, a transducer receiving spacer plate 59, a diaphragm plate 60, an ink pressure chamber plate 62, a separator plate 64, an ink inlet plate 66, a separator plate 68, an offset channel defining plate 70, a separator plate 72, and a nozzle or orifice plate 76 for the 96-nozzle ink jet print head of FIG. 8. The FIG. 8 ink jet print head is designed with multiple ink receiving manifolds that are capable of receiving various colors of ink.

The illustrated embodiment has five sets of manifolds, each set including two manifold sections. The sets of manifolds are isolated from one another such that the ink jet print head can receive five distinct colors of ink. Thus, for example, the ink jet print head can receive cyan, yellow, and magenta inks for use in full subtractive color printing together with black ink for printing text. A fifth color of ink could also be used instead of obtaining a fifth color by combining cyan, yellow, and magenta inks on the print medium. Also, because black ink is typically used to a greater extent than colored ink in applications in which both text and graphics are being printed, more than one set of manifolds may be supplied with black ink. This latter application is the specific example that will be described below.

By including multiple manifold sections for each color of ink, the distance between individual manifold sections and an associated nozzle supplied with ink by the manifold section is minimized. This minimizes dynamic ink pressures arising from accelerating and decelerating quantities of ink as an ink jet print head shuttles, for example, along a horizontal line during printing.

Figure 9:
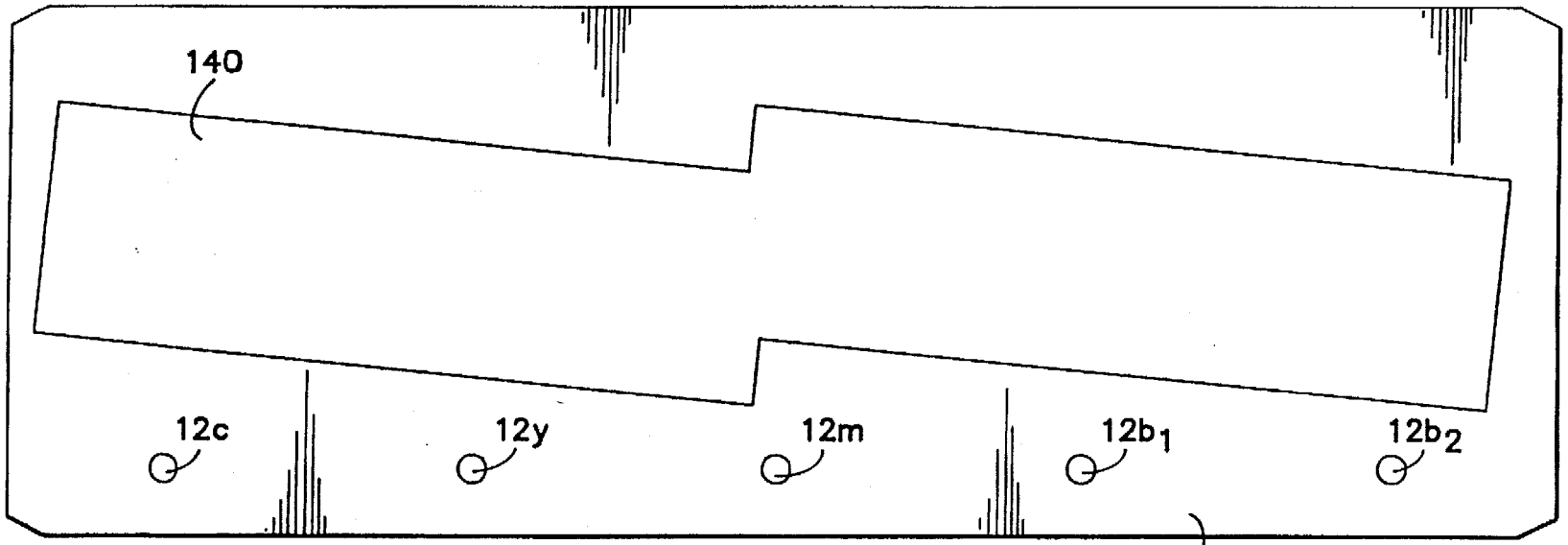
FIGS. 9–17 are frontal views of the various plates forming the array ink jet of the type illustrated in FIG. 8.

To more clearly describe the FIG. 8 embodiment of the present invention, ink flow paths through the various layers making up this embodiment will be described with reference to FIGS. 9–17. Referring to FIG. 9, spacer plate 59 is shown with an opening 140 within which piezoceramic transducers 36 (FIG. 8) are positioned. Spacer plate 59 is optional and provides at the rear of the ink jet print head a flat surface that is co-planar with the outer surface of the piezoceramic crystals. A set of ink supply inlets is provided through layer 59 through which ink is delivered to the ink jet print head. These inlets are designated 12*c* ("c" referring to the cyan color ink inlet), 12*y* ("y" referring to the yellow color ink inlet), 12*m* ("m" referring to the magenta color ink inlet), 12*b*1 ("b1" referring to a first black ink inlet), and 12*b*2 ("b2" referring to a second black ink inlet). For convenience, throughout the following description the letter suffixes c, y, and m will be used in conjunction with respective cyan, yellow, and magenta ink flow path components; the suffices b1 and b2 will be used in conjunction with flow path components supplied through the respective first and second black ink inlets; and the designation ' (prime) will be used in conjunction with tapered upper manifold components. In the preferred embodiment, the lower manifolds are not tapered. It should be noted that the various colors need not be delivered to the ink jet print head in the recited order. However, as explained below, the illustrated ink jet print head has 48 nozzles for printing colored ink at the left-hand section of the FIGS. 8–17 ink jet print head and 48 nozzles for printing black ink at the right-hand section of the ink jet print head.

Figure 10:
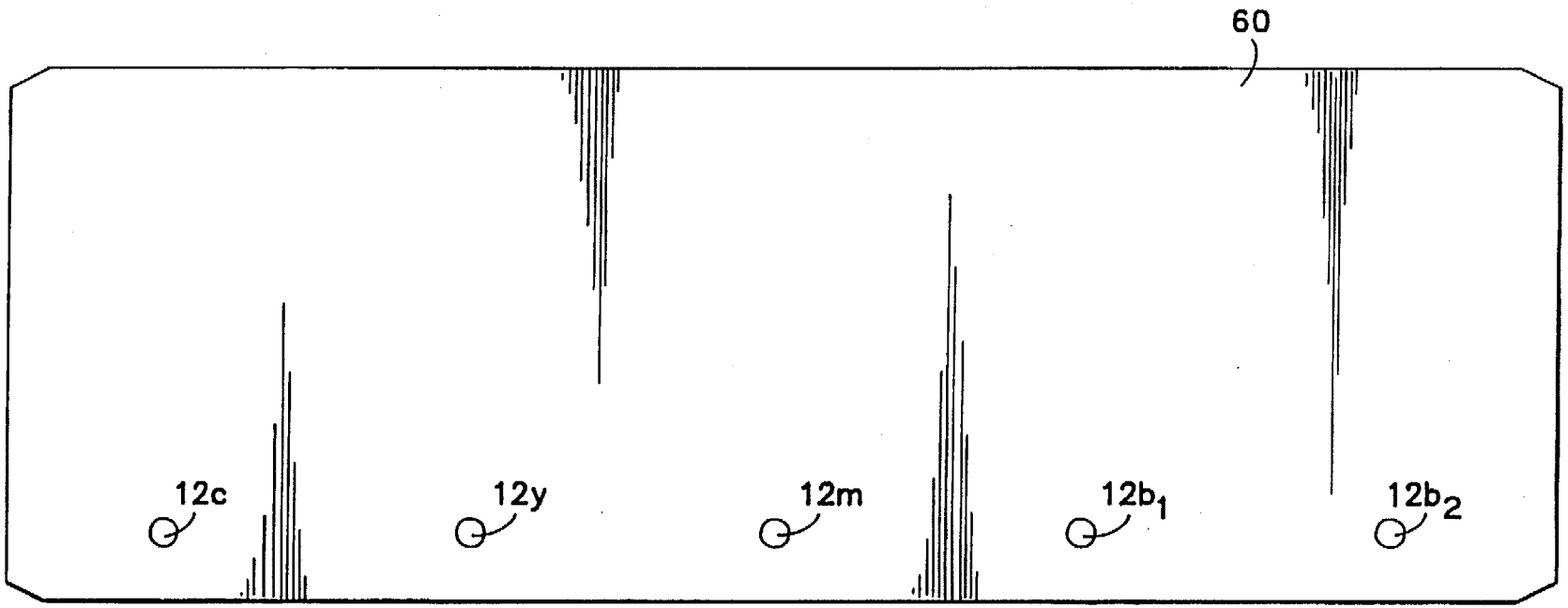

Referring to diaphragm layer 60 in FIG. 10, the respective ink inlets 12*c* through 12*b*2 also extend through this layer.

Figure 11:
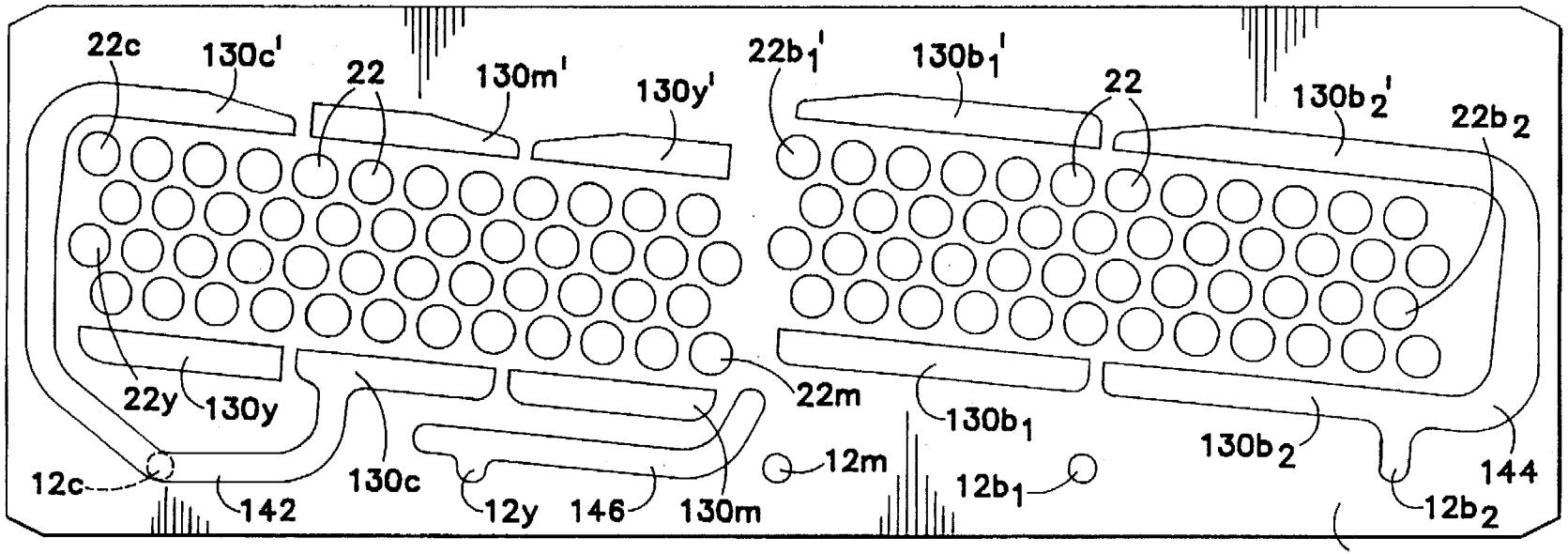

Referring to FIG. 11, cyan inlet 12*c* is coupled to a cyan ink supply channel 142 in this layer that communicates with cyan manifold sections 130*c* and 130*c*'. The manifold section 130*c* is located outside of the left-hand array of pressure transducers 22 and adjacent to the lower-middle portion of this array. The manifold section 130*c*' is located adjacent to the upper left-hand portion of this pressure chamber array. In addition, in layer 62 the ink inlet 12*b*2 communicates with a channel 144 coupled to respective black ink manifold sections 130*b*2 and 130*b*2'. Manifold section 130*b*2 is located adjacent to the lower right-hand portion of the right-most array of ink jet pressure chambers 22, and the manifold section 130*b*2' is located along the upper right-hand section of this pressure chamber array.

Yellow ink inlet 12*y* is also connected to a communication channel 146 in layer 62, although the coupling of the yellow ink to yellow ink manifold sections 130*y* and 130*y*' (FIG. 11) takes place in another layer. Also, the magenta ink supply inlet 12*m* and first black ink supply inlet 12*b*1 pass through layer 62. These inlets are coupled to respective magenta and black ink manifolds, portions of which are shown as 130*m*, 130*m*', 130*b*1 and 130*b*1' in FIG. 12, and in other layers of the ink jet print head. By including communication channels such as 142, 144 and 146 in the ink jet print head between separated manifold sections, only 5 rather than 10 ink supply ports are required. In addition, by including the manifolds in more than one layer, the depth and thus the volume of the manifolds is increased to thereby increase their acoustic compliance.

Figure 12:
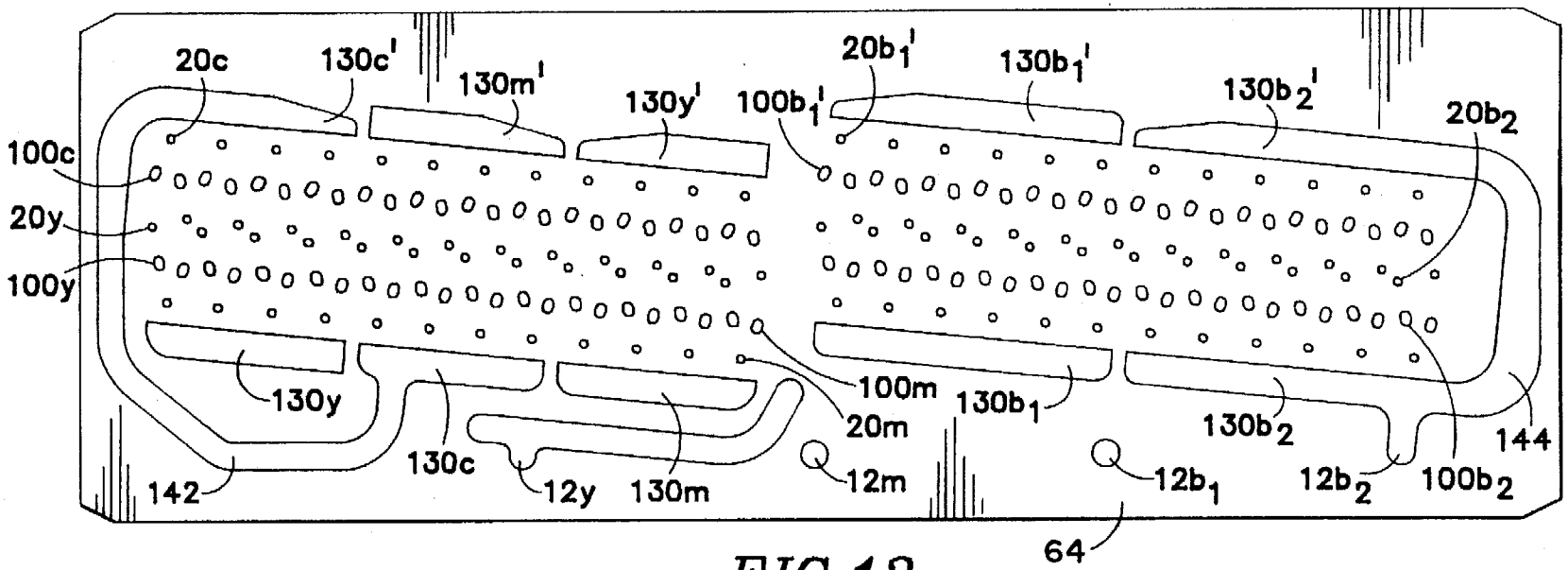

As can be seen from FIGS. 11 and 12, the manifolds and communication channels of layer 62 are aligned with similar manifolds and communication channels of layer 64. Similarly, with reference to FIG. 13 and layer 66, portions of the ink supply manifolds are included in this layer for added acoustic compliance. Layer 66 also shows passageways 12*y* and 12*y*' which communicate with the ends of the communication channel 146 in layers 11 and 12. For added volume and acoustic compliance, portions of the respective manifolds are defined by layer 66.

Figure 14:
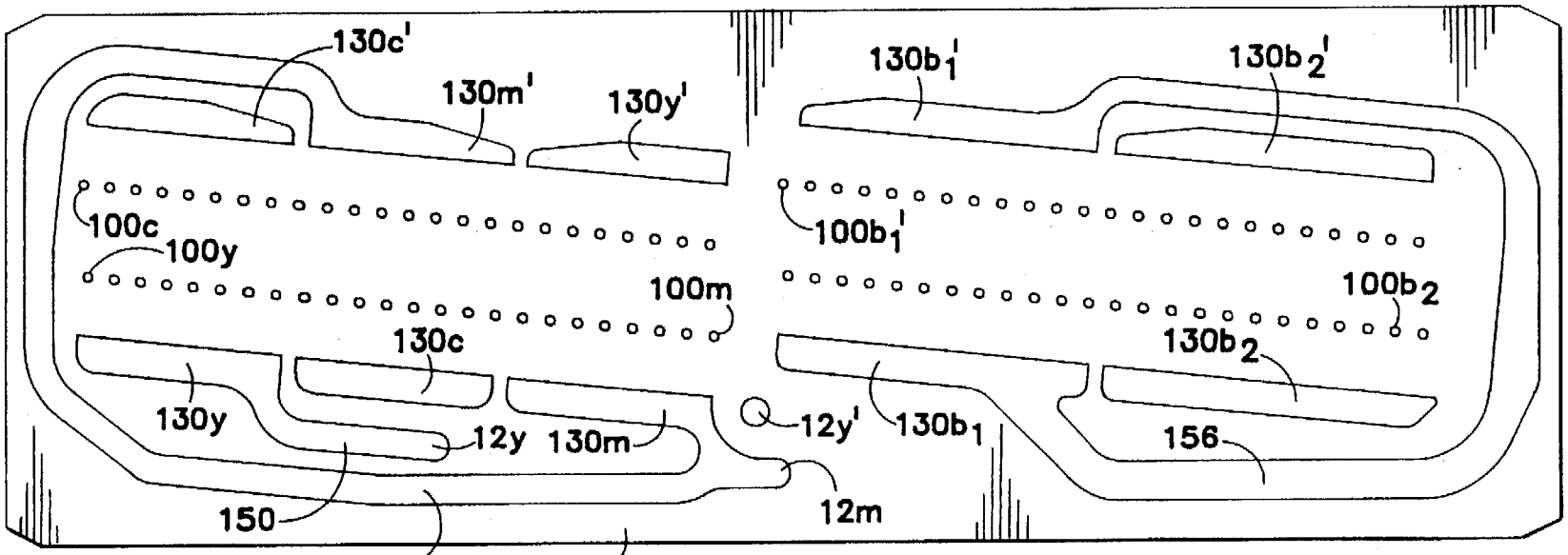
Figure 15:
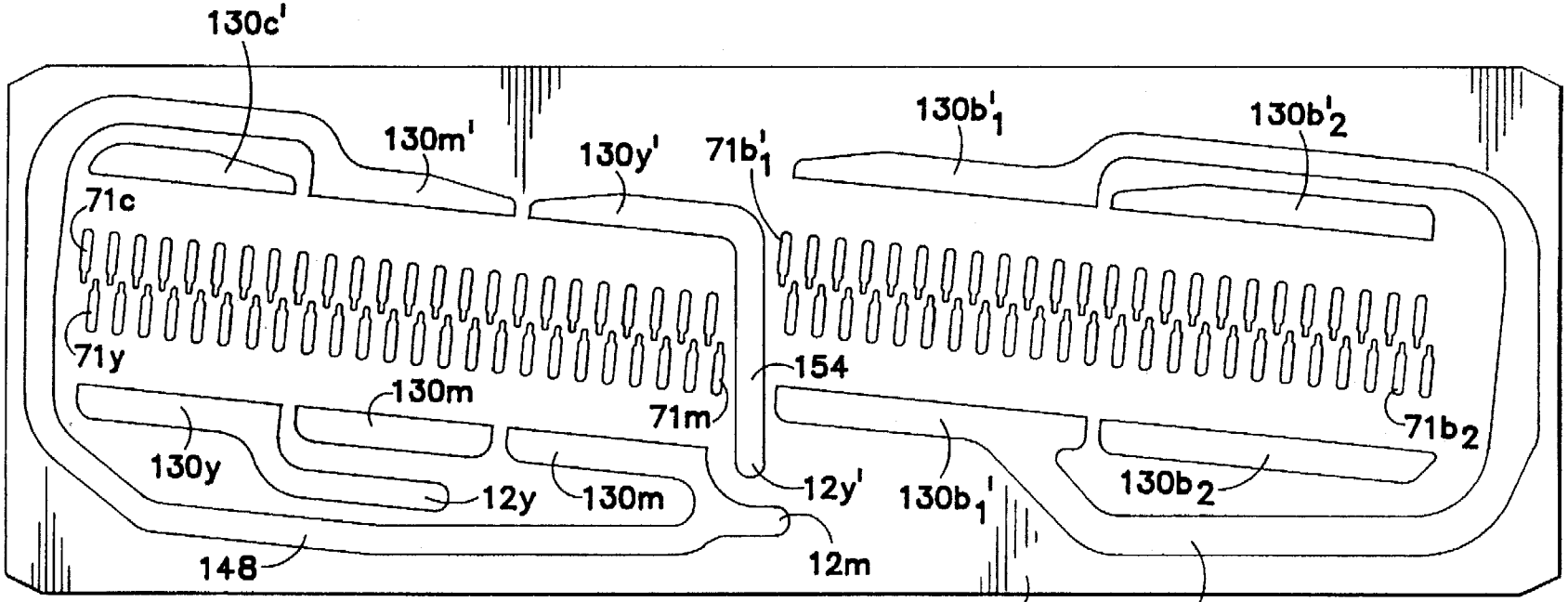
Figure 16:
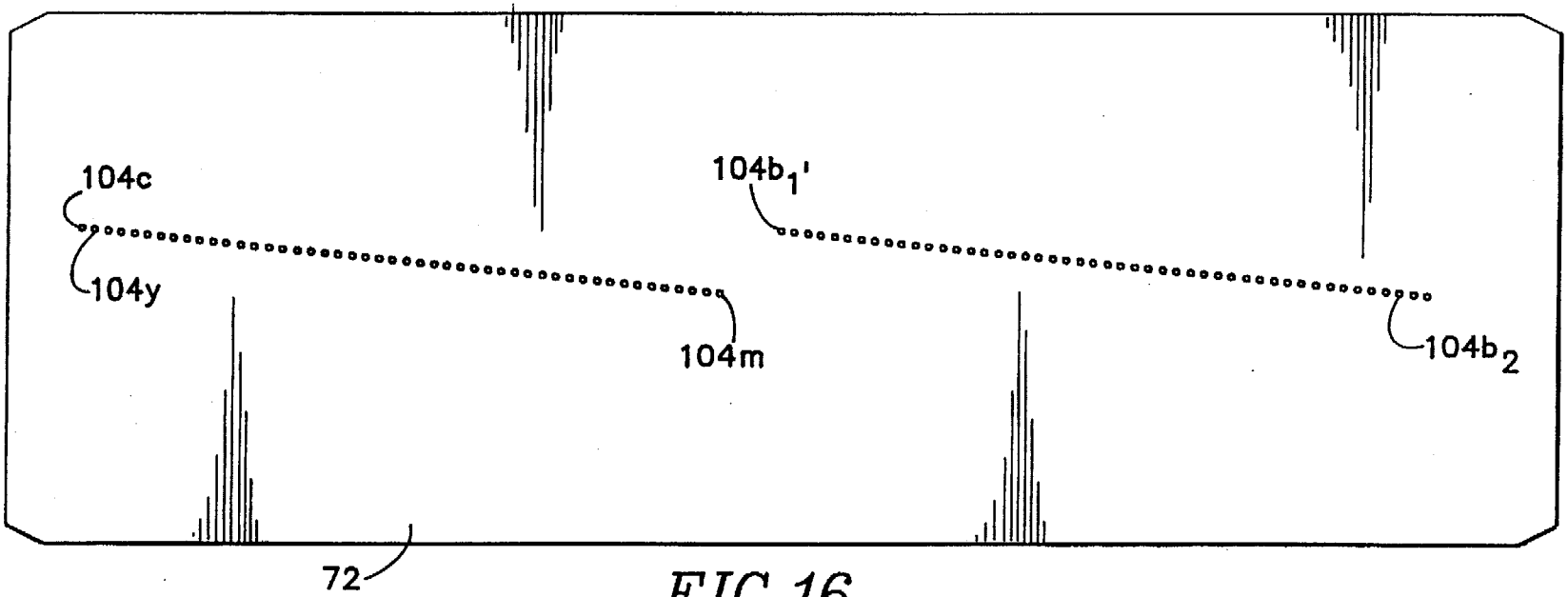

Referring to FIGS. 14 and 15, the magenta inlet passage 12*m* is coupled to a communication channel 148 and by way of this channel 148 to the magenta manifold sections 130*m* and 130*m*'. The yellow ink supply inlet 12*y* is coupled by a channel 150 to the manifold section 130*y* (FIG. 14) and the yellow inlet channel 12*y*' is coupled by a communication channel 154 (FIG. 15) to the yellow ink manifold section 130*y*'. The black ink supply inlet 12*b*1 communicates with a passageway 156 in layers 68 and 70 (FIGS. 14 and 15) and by way of this passageway 156 to the black ink manifold sections 130*b*1 and 130*b*1'.

Therefore, in the above manner each of the ink manifold sections is supplied with ink. Also, the volume of the individual manifold sections is increased by including portions of the manifold sections in multiple layers.

For purposes of further illustration, delivery of ink from these manifolds to selected black, cyan, magenta, and yellow ink pressure chambers 22*b*1 and 22*b*2, 22*c*, 22*m*, and 22*y* (FIG. 11) will be described. The flow of ink from these ink pressure chambers to their associated respective nozzles will also be described. From this description, the flow paths of ink to the other pressure chambers and nozzles will be readily apparent.

Referring to FIGS. 13 and 14, ink from cyan manifold section 130*c*' flows into an ink inlet 132*c* of an ink supply channel 102*c*. Ink flows from channel 102*c* through an ink pressure chamber supply inlet 20*c* (layers 66 and 64 in FIGS. 13 and 12) and into the upper portion of the ink pressure chamber 22*c* (layer 62 in FIG. 11). Ink passes across the ink pressure chamber 22*c*, exits from chamber 22*c* by way of a passageway 100*c* (layers 64, 66, and 68; FIGS. 12, 13, and 14), and flows to the upper end of an offset channel 71*c* (layer 70, FIG. 15). From the lower end of the offset channel 71*c*, ink flows through an opening 104*c* (layer 72, FIG. 16) to an associated nozzle 14*c* (layer 76, FIG. 17).

In the same manner, ink from yellow ink manifold section 130*y* (FIG. 14) enters an inlet 132*y* (FIG. 13) of an ink supply channel 102*y*. From ink supply channel 102*y*, ink flows through a passageway 20*y* (layers 66 and 64, FIGS. 13 and 12) to the upper portion of the ink pressure chamber 22*y*. From the lower portion of the ink pressure chamber, ink flows through a passageway 100*y* (layers 64, 66 and 68, FIGS. 12, 13 and 14) to the lower end of an offset channel 71*y* (layer 70, FIG. 15). From the upper end of this offset channel, ink flows through an opening 104*y* (layer 72, FIG. 16) and to a nozzle 14*y* (layer 76, FIG. 17). In the same manner, the ink supply to and from the pressure chambers 22*m*, 22*b*1 and 22*b*2 are indicated with numbers corresponding to the numbers used above and with the respective subscripts m, b1 and b2.

Figure 17:
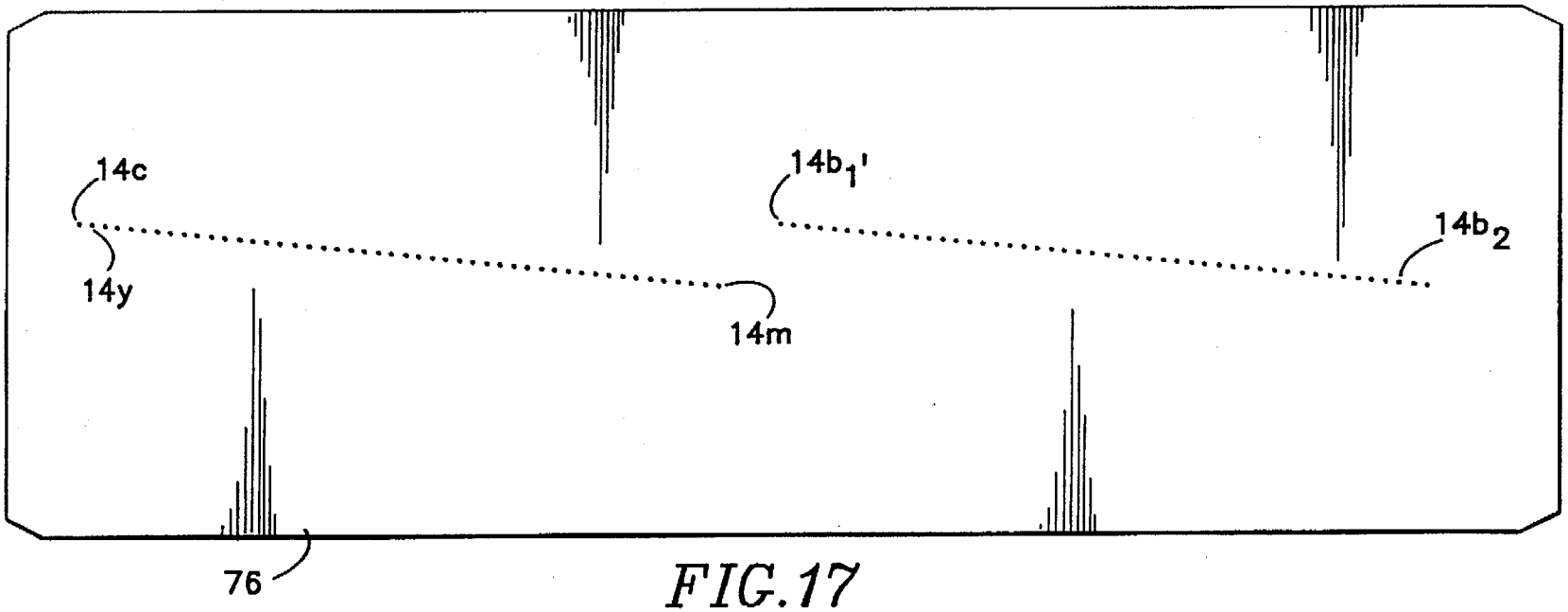

Referring to FIGS. 8, 15 and 17, with the manifolding arrangement described above, the 48 offset channels in the right-hand array of FIG. 15 are supplied with black ink along with the 48 nozzles in FIG. 17 included in the right-hand row of nozzles of the orifice plate 76. The first eight offset channels of the upper row of offset channels in the left-hand offset channel array of FIG. 15 are supplied with cyan ink, the next eight offset channels in this row are supplied with magenta ink, and the third group of eight offset channels in this row are supplied with yellow ink. In addition, the first eight offset channels in the lower row of this left-hand offset channel array are supplied with yellow ink, the next eight offset channels of this lower row are supplied with cyan ink, and the last group of eight offset channels of this lower row are supplied with magenta ink.

Because of the interleaved nature of the upper ends of the lower offset channels and the lower ends of the upper offset channels of FIG. 15, the nozzles of the ink jet print head of this construction (see FIG. 17) are supplied with interleaved colors of ink in adjacent nozzles in the left-hand row of nozzles of FIG. 17. This facilitates color printing because the vertical spacing between nozzles of a given color of ink is at least two addresses apart. The manifolding and ink supply arrangements can be easily modified to alter the interleaved arrangement of nozzle colors as desired. Therefore, FIG. 8 illustrates a compact, easily manufacturable and advantageous ink jet print head of the present invention.

It will be obvious to those having skill in the art that many changes may be made to the details of the above-described embodiment of this invention without departing from the underlying principles thereof. Accordingly, it will be appreciated that this invention is also applicable to applications other than those found in drop-on-demand ink jet recording and printing. The scope of the present invention should, therefore, be determined only by the following claims.

We claim:

1. An ink jet printer system having a multiple-nozzle print head coupled to an ink source for ejecting ink through a plurality of nozzles as the ink moves in a direction of ink flow between a supply source and the plurality of nozzles, comprising:

an ink supply manifold having a first end and a second end, the first end being coupled to the ink source and having a greater cross-sectional area than at any other point in the ink supply manifold so that it is tapered from greater cross-sectional area to lesser cross-sectional area in the direction of ink flow, the ink supply manifold further having multiple ink pressure chambers positioned between multiple ink inlets of substantially equal lengths and equal cross-sectional areas and multiple passages of substantially equal length and equal cross-sectional areas to thereby create equal ink fluid impedances between the multiple ink inlets;

multiple nozzles coupled to the ink supply manifold by separate ink channels through openings distributed between the first and second ends;

transducers connected to the ink supply manifold and coupled to the ink pressure chambers, the transducers being drivern with substantially similar waveforms to draw ink from the ink source through the manifold and inlet channels and to expel ink from each pressure chamber through a corresponding associated passage and nozzle in a manner exhibiting substantially identical jetting characteristics;

and a purging mechanism connectable to the print head causing ink to flow by application of a vacuum at the same ink flow rate into the first end of the ink supply manifold, through the ink supply manifold at a flow rate, and from the ink manifold through the ink channels to the nozzles;

whereby a tapered difference in cross-sectional area in the ink supply manifold at the first end from that at any other point toward the second end is such that the taper is from greater cross-sectional area to lesser cross-sectional area in the direction of ink flow and causes the ink flow rate in the ink supply manifold to create a resultant force that acts on bubbles that is the result from the effort of gravitational force, buoyant force and an ink flow rate induced force, the ink flow rate being everywhere sufficient so that contaminants or bubbles are effectively purged from the ink supply manifold by causing the bubbles to move in the direction of ink flow and direction of the resultant force.

2. The apparatus of claim 1 in which the purging mechanism causes ink to flow in a direction from the nozzles toward the source of ink.

3. The apparatus of claim 1 in which the ink supply manifold is oriented elevationally above the nozzles and substantially only bubbles are purged from the print head.

4. A multiple-nozzle ink jet print head purgeable of contaminants or bubbles for receiving ink from a source of ink and for ejecting ink from a plurality of nozzles, the ink moving in a direction of ink flow between the source of ink and the nozzles, comprising:

a body containing an ink manifold coupled to the source of ink, the ink manifold having a continuously decreasingly tapered cross-sectional area in the direction of ink flow between first and second ends thereof; the body further containing multiple ink pressure chambers of substantially circular cross-sectional area positioned between diametrically opposed ink inlet channels of substantially equal lengths and ink passages of substantially equal lengths, the ink inlet channels being of substantially equal lengths and cross-sectional areas thereby having equal ink fluid impedances, the ink inlet channels further being coupled to the ink manifold at points distributed between the first and second ends to deliver ink through different ones of the passages and ink pressure chambers to a nozzle associated with each ink pressure chamber; and the body having multiple purging channels, each disposed between an associated passage and nozzle and coupled to a common ink outlet;

transducers mounted to the body and coupled to the ink pressure chambers, the transducers being driven with substantially similar waveforms to draw ink from the source of ink through the manifold and inlet channels and to expel ink from each pressure chamber through a corresponding associated passage and nozzle in a manner exhibiting substantially identical jetting characteristics thereby creating an ink flow rate within the decreasingly tapered cross-sectional area of the manifold that includes a resultant force that acts on bubbles within the manifold which is the result of the coactive effect of gravitational force, buoyant force and an ink flow rate induced force to force bubbles from the manifold into the ink pressure chambers;

acoustic drivers connected to the transducers to provide the waveforms to drive to transducers; and a purging mechanism connectable to the print head causing by the application of a vacuum ink to flow through the print head, whereby the manifold, pressure chambers, and purging channels are sized for ink volume and flow rate and positioned to cause the ink flow to remove the contaminants or bubbles in the print head.

5. The apparatus of claim 4 in which the purging mechanism causes ink to flow in a direction from the source of ink toward the ink outlet.

6. The apparatus of claim 4 in which the ink manifold is oriented elevationally above the nozzles and substantially only bubbles are purged from the print head.

7. A method for purging contaminants or bubbles from a multiple-orifice ink jet head from which ink is ejected through a plurality of orifices, comprising the steps of:

providing an ink supply manifold having a volume and first and second ends, the ink supply manifold being in fluid communication in a direction of ink flow between the ink supply manifold and the orifices with multiple ink supply channels of substantially equal lengths and cross-sectional areas to thereby create equal ink fluid impedances between the multiple ink supply channels, the ink supply channels being distributed at locations between the first and second ends, the ink supply manifold having at least a portion of the volume in the direction of ink flow tapered to define a first cross-sectional area and a smaller second cross-sectional area between the first and second ends such that the smaller cross-sectional area is located adjacent to the second end;

causing ink to flow at a flow rate through an ink inlet adjacent to the first end of the ink supply manifold by the action of a plurality of transducers connected to the manifold, the transducers being driven with substantially similar waveforms so that ink expelled from the plurality of orifices exhibit substantially identical jetting characteristics; and drawing ink from the ink supply channels at the same flow rate by the application of a vacuum, whereby the tapered volume portion in the direction of ink flow maintains everywhere within the ink supply manifold a flow rate that includes a resultant force that acts on bubbles within the manifold which is the result of the effect of gravitational force, buoyant force and an ink flow rate induced force to direct the bubbles out of the manifold in the direction of ink flow, the flow rate thereby being sufficient to purge the ink supply manifold of contaminants or bubbles carried by the ink as the ink is drawn from the ink supply channels.

8. The method of claim 7 in which the ink flow in the ink supply manifold is in a direction from the ink inlet toward the ink supply channels.

9. The method of claim 7 in which the ink supply manifold is oriented elevationally above the ink supply channels and substantially only bubbles are purged from the multiple-orifice ink jet head.

* * * * *

UNITED STATES PATENT AND TRADEMARK OFFICE

CERTIFICATE OF CORRECTION

PATENT NO. : 5,677,718
DATED : October 14, 1997
INVENTOR(S) : Clark W. Crawford and Ronald F. Burr It is certified that error appears in the above-identified patent and that said Letters Patent is hereby corrected as shown below:

Column 15, line 52, after "being" and before "with" change "drivern" to --driven--.

Signed and Sealed this

Sixth Day of January, 1998

*Attest:*

*Attesting Officer*

BRUCE LEHMAN

*Commissioner of Patents and Trademarks*